US012716637B2

(12) United States Patent
Kim et al.

(10) Patent No.: US 12,716,637 B2
(45) Date of Patent: Aug. 25, 2026

(54) REFRIGERATOR

(71) Applicant: LG ELECTRONICS INC., Seoul (KR)

(72) Inventors: Dong Hwi Kim, Seoul (KR); Kihwang Kim, Seoul (KR); Yongbum Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 389 days.

(21) Appl. No.: 18/110,490

(22) Filed: Feb. 16, 2023

(65) Prior Publication Data

US 2023/0304722 A1 Sep. 28, 2023

(30) Foreign Application Priority Data

Feb. 25, 2022 (KR) ..... 10-2022-0025497

(51) Int. Cl.
*F25D 17/06* (2006.01)

(52) U.S. Cl.
CPC ..... *F25D 17/065* (2013.01)

(58) Field of Classification Search
CPC ..... F25D 17/065; F25D 17/08; F25D 17/045
See application file for complete search history.

(56) References Cited

U.S. PATENT DOCUMENTS 10,969,155 B2 4/2021 Chae et al.
11,668,511 B2 6/2023 Lee et al.
2008/0196441 A1 8/2008 Ferreira et al.
2017/0343269 A1 11/2017 Kim et al.
2018/0347886 A1 12/2018 Chae et al.
2019/0323758 A1* 10/2019 Kim ..... F25D 17/065
2020/0103158 A1 4/2020 Kim et al.
2020/0284493 A1 9/2020 Lee et al.
2022/0011035 A1 1/2022 Lee et al.
(Continued)

FOREIGN PATENT DOCUMENTS

CN 113494808 A 10/2021
KR 20000010258 A 2/2000
(Continued)

OTHER PUBLICATIONS

Kawai et al. (KR20110011510A), English Translation, Refrigerator, 2011, Whole Document (Year: 2011).*
(Continued)

*Primary Examiner* — Jerry-Daryl Fletcher
*Assistant Examiner* — Keith Stanley Myers
(74) *Attorney, Agent, or Firm* — Fish & Richardson P.C.

(57) ABSTRACT

A refrigerator includes a freezer compartment, a refrigerator compartment, a flow path duct assembly being disposed at a rear of the refrigerator compartment and comprising a cold air flow path, a grille fan assembly disposed at a rear of the freezer compartment, and a supply duct assembly that fluidly communicates with the flow path duct assembly and the grille fan assembly and supplies cold air that is blown from the grille fan assembly to the flow path duct assembly. The flow path duct assembly includes a flow path duct cold air inlet depressed to fluidly communicate with the supply duct assembly, and the cold air flow path exposed by the flow path duct cold air inlet is open in an upward direction of the flow path duct assembly and closed in a downward direction of the flow path duct assembly.

22 Claims, 19 Drawing Sheets

(56) References Cited

U.S. PATENT DOCUMENTS

| | | | |
|---|---|---|---|
| 2022/0099352 | A1 | 3/2022 | Lee et al. |
| 2022/0252325 | A1 | 8/2022 | Lee et al. |
| 2022/0316788 | A1 | 10/2022 | Lee et al. |

FOREIGN PATENT DOCUMENTS

| | | | |
|---|---|---|---|
| KR | 20010056077 | | 7/2001 |
| KR | 100364991 | | 3/2003 |
| KR | 20110011510 | A | 2/2011 |
| KR | 20170132631 | A | 12/2017 |
| KR | 20170133840 | A | 12/2017 |
| KR | 20180132317 | A | 12/2018 |
| KR | 20200053106 | A | 5/2020 |
| KR | 20200107390 | A | 9/2020 |
| KR | 20220016929 | A | 2/2022 |

OTHER PUBLICATIONS

Extended European Search Report in European Appln. No. 23155534.3, mailed on Jul. 24, 2023, 8 pages.
Office Action in Korean Appln. No. 20220025497, mailed on Sep. 20, 2023, 21 pages (with English translation).
Notice of Allowance in Korean AppIn. No. 20220025497 mailed on Nov. 21, 2023, 2 pages (English translation).
Notice of Allowance in Korean Appln. No. 10-2024-0024470 mailed on Mar. 7, 2025, 10 pages (English translation).

* cited by examiner

REFRIGERATOR

CROSS-REFERENCE TO RELATED APPLICATION

This application claims priority to and the benefit of Korean Patent Application No. 10-2022-0025497, filed on Feb. 25, 2022, the disclosure of which is incorporated herein by reference in its entirety.

TECHNICAL FIELD

Disclosed herein is a double-door refrigerator, and in particular, a refrigerator that can suppress ice formation of a cold air flow path and a damper, caused by the inflow of humid air.

BACKGROUND

Refrigerators generate cold air by circulating refrigerants and provide the cold air to a storage compartment such as a refrigerator compartment or a freezer compartment, to store various types of storage targets for a long period of time and keep the storage targets fresh, in the storage compartment.

A refrigerator compartment is used to keep a storage target cold, and a freezer compartment is used to keep a storage target frozen. In this context, the amount of cold air that is supplied to the refrigerator compartment and the freezer compartment needs to be adjusted differently such that the refrigerator compartment and the freezer compartment have a different temperature.

Refrigerants, circulating in a compressor, a condenser, an evaporator and the compressor consecutively, flow into the evaporator, and while refrigerant liquids are changed into refrigerant gases, the refrigerant takes away heat in a refrigerator, to generated cold air. Then the cold air is supplied to the refrigerator compartment and the freezer compartment.

To increase the volume of the refrigerator compartment, a single evaporator in the freezer compartment can be used to supply cold air to both the refrigerator compartment and the freezer compartment.

The cold air generated by the evaporator can be blown to the freezer compartment and the refrigerator compartment by a grille fan assembly and can be supplied up to the refrigerator compartment through a supply duct assembly allowing the refrigerator compartment and the freezer compartment to communicate with each other.

At this time, since a single evaporator and a single grille fan assembly need to supply cold air to the refrigerator compartment and the freezer compartment that require a different temperature of cold air and a different amount of cold air, a flow path opening and closing damper capable of selectively blocking cold air that is supplied to the refrigerator compartment can be additionally provided.

That is, at a time when cold air is supplied to the refrigerator compartment, the flow path opening and closing damper is open, and the cold air can be supplied to the refrigerator compartment through the supply duct assembly.

When a sufficient amount of cold air is supplied so that the temperature of the refrigerator compartment reaches a desired temperature of the refrigerator compartment, the flow path opening and closing damper is closed, and a cold air flow path running from the freezer compartment to the refrigerator compartment is blocked.

When the flow path opening and closing damper is blocked, the natural convection of humid air, i.e., cold air of the refrigerator compartment, which has a relatively high temperature and high humidity, is performed, and the humid air can flow reversely into a vacant space of the cold air flow path.

For example, the humid air can flow reversely into the supply duct assembly where the supply of cold air is cut off by the flow path opening and closing damper, and be attached to a cold air flow path of a relatively cold supply duct assembly and form ice.

If the temperature of the refrigerator compartment does not reach a desired temperature of the refrigerator compartment, the flow path opening and closing damper is open, and cold air that has a relatively low temperature and low humidity can be supplied into the supply duct assembly again.

If cold air is supplied again in the state where ice formation of the cold air flow path of the supply duct assembly occurs, dehumidification and sublimation can occur at the ice-formed cold air flow path, but if the amount of ice formation is greater than the amount of dehumidification, the ice formed is grown.

When ice formation occurs at the cold air flow path of the supply duct assembly, it can interfere with the flow of cold air in the cold air flow path, ice formation can occur at a damper door of the flow path opening and closing damper, and the damper door cannot be opened properly, making it hard to supply cold air to the refrigerator compartment.

To solve the problem of ice formation, a heater can be used to suppress ice formation, but causes high electricity consumption.

SUMMARY

Technical Problems

The objective of the present disclosure is to provide a refrigerator comprising a flow path duct assembly that can have a cold air flow path of a novel structure and suppress ice formation of a cold air flow path of a supply duct assembly which supplies cold air to the flow path duct assembly and ice formation of a flow path opening and closing damper.

Further, the objective of the present disclosure is to provide a refrigerator comprising a supply duct assembly of a novel structure that can suppress ice formation of a cold air flow path of the supply duct assembly and ice formation of the flow path opening and closing damper.

Further, the objective of the present disclosure is to provide a refrigerator comprising a flow path opening and closing module of a novel structure and a novel arrangement that can suppress ice formation of the cold air flow path of the supply duct assembly and ice formation of the flow path opening and closing damper.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solutions

A refrigerator of one embodiment is characterized in that a cold air flow path exposed by a flow path duct cold air inlet of a flow path duct assembly that communicates with a supply duct assembly is open in the upward direction of the flow path duct assembly and closed in the downward direction of the flow path duct assembly.

Specifically, since the cold air flow path exposed by the flow path duct cold air inlet of the flow path duct assembly is open in the upward direction and closed in the downward direction, the downward drooping of cold air can be prevented and the flow of humid air into a vacant space, caused by the drooping of cold air, can be suppressed.

The refrigerator comprises a freezer compartment, a refrigerator compartment being disposed at one side of the freezer compartment, a flow path duct assembly being disposed at the rear of the refrigerator compartment and comprising a cold air flow path, a grille fan assembly being disposed at the rear of the freezer compartment, and a supply duct assembly having one side and the other side that respectively communicate with the flow path duct assembly and the grille fan assembly, and supplying cold air that is blown from the grille fan assembly to the flow path duct assembly.

The flow path duct assembly comprises a flow path duct cold air inlet being depressed to communicate with the supply duct assembly, and the cold air flow path exposed by the flow path duct cold air inlet is open in the upward direction of the flow path duct assembly and closed in the downward direction of the flow path duct assembly.

In another aspect, the flow path duct cold air inlet may be surrounded by a lower side wall comprising a first inclination wall and a second inclination wall that protrude in the downward direction, one side wall extending from one side of the first inclination wall in the upward direction, and the other side wall extending from the other side of the second inclination wall in the upward direction, and the first inclination wall may face the other side wall.

In another aspect, the flow path duct assembly may further comprise a step part being disposed in the lower area of the flow path duct cold air inlet.

In another aspect, the flow path duct assembly may further comprise a first cold air guide part looking like an island and being disposed in the upper area of the flow path duct assembly, and the other wall of the first cold air guide part may be one side wall of the flow path duct cold air inlet.

In another aspect, the flow path duct assembly may further comprise a first cold air outlet supplying cold air to the refrigerator compartment, and the first cold air outlet may be disposed in the upper portions of the first cold air guide part and the flow path duct cold air inlet, and spaced from the first cold air guide part and the flow path duct cold air inlet.

In another aspect, the flow path duct assembly may further comprise a second cold air guide part looking like an island, and being disposed in the lower portion of the first cold air guide part and spaced from the first cold air guide part.

In another aspect, the cold air flow path may comprise a first cold air flow path allowing cold air having flown into the flow path duct cold air inlet to flow to the first cold air outlet along the other side wall of the first cold air guide part, a second cold air flow path being branched from the first cold air flow path and allowing cold air to flow along the upper side wall and one side wall of the first cold air guide part and along one side wall of the second cold air guide part, a third cold air flow path being branched from the second cold air flow path and allowing cold air to flow to a first subsidiary cold air outlet that is disposed at one side of the first cold air outlet, and a fourth cold air flow path being branched from the second cold air flow path and allowing cold air to flow along the other side wall of the second cold air guide part.

In another aspect, a flux of cold air flowing along one side wall of the second cold air guide part may be greater than a flux of cold air flowing along the other side wall of the second cold air guide part.

In another aspect, the first cold air outlet may be disposed to overlap the first cold air guide part and the flow path duct cold air inlet in the up-down direction.

In another aspect, a subsidiary cold air guide part may be provided at the upper side of the first cold air guide part, and comprise a third inclination wall and a fourth inclination wall that protrude in the upward direction, the fourth inclination wall may be disposed closer to the flow path duct cold air inlet than the third inclination wall, and the third inclination wall may have a longer side than the fourth inclination wall.

In another aspect, a lower side extension part may be provided at the lower side of the second cold air guide part, and extend in a way that the width of the lower side extension part decreases in the downward direction, and a curved surface part may be provided at one side of the lower side extension part through which the second cold air flow path passes, and have a curvature center in a direction of one side of the flow path duct assembly.

In another aspect, a supply duct cold air outlet may be provided at one side of the supply duct assembly and be open to communicate with the flow path duct cold air inlet, a supply duct cold air inlet may be provided at the other side of the supply duct assembly and be open to communicate with a grille fan cold air outlet, and a first lower side inclination part may be provided at the lower side of the supply duct cold air outlet, and decrease the open area from the other side of the supply duct assembly further toward one side of the supply duct assembly.

In another aspect, a second lower side inclination part may be provided at the lower side of the supply duct cold air outlet and increase the open area from the other side of the supply duct assembly further toward one side of the supply duct assembly, and may be disposed closer to the other side of the supply duct assembly than the first lower side inclination part.

In another aspect, a jaw part may be provided at the upper side of the supply duct cold air outlet and decrease the open area from one side of the supply duct assembly further toward the other side of the supply duct assembly.

In another aspect, a supply duct connection part may be disposed between the supply duct cold air outlet and the supply duct cold air inlet, and an upper drawn part may be provided at the upper side of the supply duct connection part and be drawn inward.

In another aspect, a lower side drawn part may be provided at the lower side of the supply duct connection part and be drawn inward, and the upper side drawn part and the lower side drawn part may not overlap each other.

In another aspect, the grille fan assembly may comprise a flow path opening and closing module comprising a damper that selectively blocks cold air which is supplied to the supply duct assembly, the damper may comprise a damper case comprising a damper passage hole through which cold air passes, a damper door being disposed on one surface of the damper case and opening and closing the damper passage hole, and a damper operation motor being disposed at one side of the damper case and operating the damper door to allow the damper door to be opened and closed, one surface of the damper case may be disposed to face an inside of the grille fan assembly, and the damper door may be opened and closed in a direction of the inside of the grille fan assembly.

In another aspect, the uppermost end of the damper passage hole may be disposed lower than the uppermost end of the flow path duct cold air inlet.

In another aspect, the rotation shaft of the damper door may be in parallel with the supply duct cold air inlet of the supply duct assembly.

In another aspect, the flow path opening and closing module may further comprise a first damper cover and a second damper cover that respectively surround one side and the other side of the damper, the damper door may be open in the direction in which the first damper cover is disposed, and the first damper cover may comprise a damper cover blocking part that is disposed to overlap at least a portion of the damper door when the damper door is opened.

In another aspect, cold air that is blown from the grille fan assembly may flow to a fifth cold air flow path in which cold air flows between the damper door and the second damper cover, and a sixth cold air flow path in which cold air flows between the damper door and the damper cover step part, and pass through the damper passage hole.

In another aspect, a first inclination surface may be provided in the lower area of the second damper cover, contacting the lower side of the damper, and incline in the direction of the grille fan assembly.

Advantageous Effects

In a refrigerator of the present disclosure, since a cold air flow path exposed by a flow path duct cold air inlet of a flow path duct assembly is open in the upward direction and closed in the downward direction, the downward drooping of cold air can be prevented and the flow of humid air into a vacant space, caused by the drooping of cold air, can be suppressed.

In the refrigerator, the flow path duct assembly comprising a cold air flow path of a novel structure can help to suppress ice formation of a cold air flow path of a supply duct assembly and ice formation of a flow path opening and closing damper.

In the refrigerator, since a first lower side inclination part is provided at the lower side of a supply duct cold air outlet, decreases an open area from the other side of the supply duct assembly further toward one side of the supply duct assembly, and functions as a structure for preventing the drooping of cold air, the flow of humid air into a vacant space, caused by the drooping of cold air, can be suppressed further.

In the refrigerator, the supply duct assembly of a novel structure can help to suppress ice formation of the cold air flow path of the supply duct assembly and ice formation of the flow path opening and closing damper.

In the refrigerator, since a damper door of a damper is opened and closed toward the inside of a grille fan assembly, the surface area of the damper door, exposed to humid air, can decrease, and since the uppermost end of a damper passage hole is disposed lower than the uppermost end of the flow path duct cold air inlet, the exposure of the damper to humid air can be suppressed further in a way that the humid air is locked in cold air.

In the refrigerator, a flow path opening and closing module of a novel structure and a novel arrangement can help to suppress ice formation of the cold air flow path of the supply duct assembly and ice formation of the flow path opening and closing damper.

Specific effects are described along with the above-described effects in the section of detailed description.

BRIEF DESCRIPTION OF DRAWINGS

The accompanying drawings constitute a part of the specification, illustrate one or more embodiments in the disclosure, and together with the specification, explain the disclosure.

DETAILED DESCRIPTION

Figure 1:
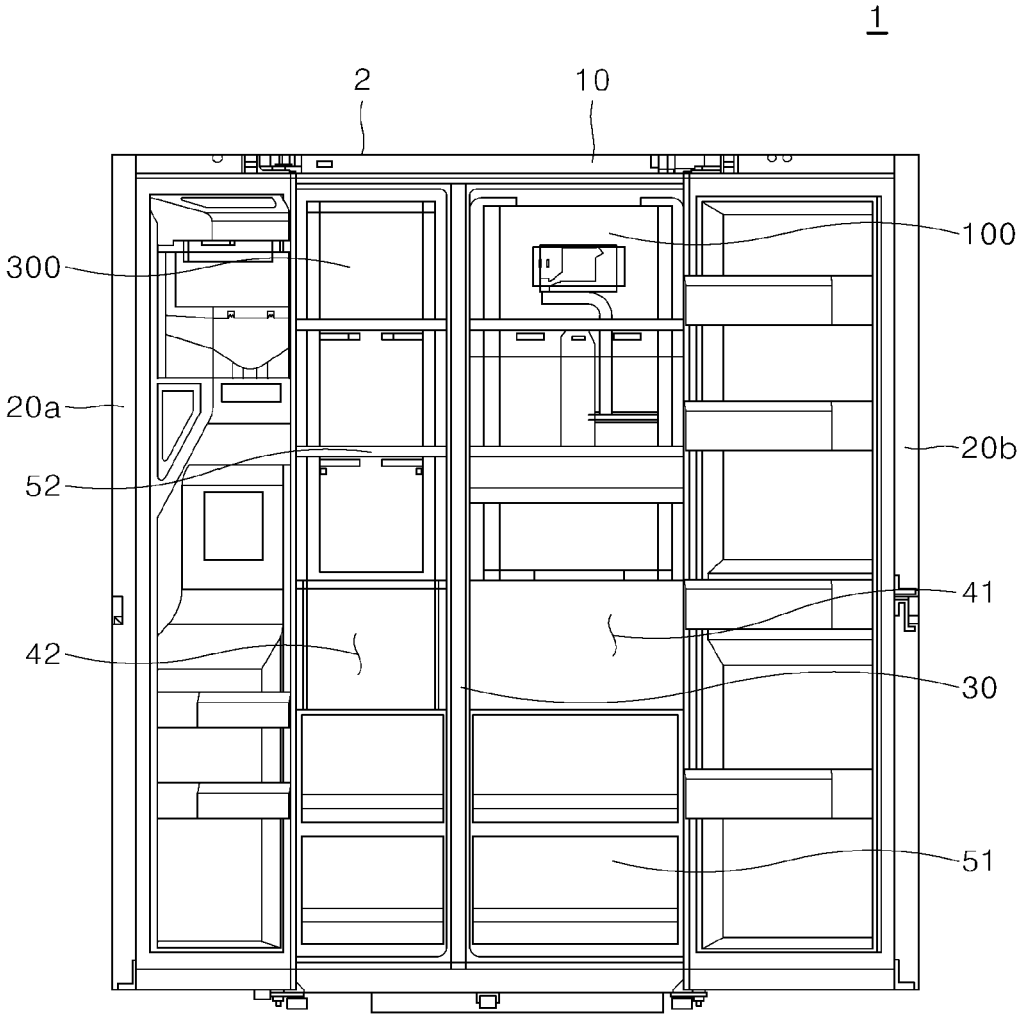
FIG. 1 is a front view showing a double-door refrigerator with the doors open.

The above-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

The terms “first”, “second” and the like are used herein only to distinguish one component from another component.

Thus, the components should not be limited by the terms. Certainly, a first component can be a second component, unless stated to the contrary.

Throughout the disclosure, each component can be provided as a single one or a plurality of ones, unless explicitly stated to the contrary.

When any one component is described as being "in the upper portion (or lower portion)" or "on (or under)" another component, any one component can be directly on (or under) another component, but an additional component can be interposed between any one component and another component on (or under) any one component.

When any one component is described as being "connected", "coupled", or "connected" to another component, any one component can be directly connected or coupled to another component, but an additional component can be "interposed" between the two components or the two components can be "connected", "coupled", or "connected" by an additional component.

The singular forms "a", "an" and "the" are intended to include the plural forms as well, unless explicitly indicated otherwise. It is to be understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the phrase "A and/or B" as used herein can denote A, B or A and B, and the phrase "C to D" can denote C or greater and D or less, unless stated to the contrary.

Hereafter a refrigerator in several embodiments is described.

[Entire Structure of Refrigerator]

FIG. 1 is a front view showing a double-door refrigerator with the doors open.

The exterior of a refrigerator 1 is formed by a cabinet 2 that forms a storage space, and a door that opens and closes the cabinet 2's open front.

The cabinet 2 may comprise an outer case 10 that forms the outer surface of the refrigerator 1, and an inner case 30 that forms the inner surface of the refrigerator 1.

The outer case 10 and the inner case 30 are spaced from each other and have a separation space therebetween, and an insulator may foam in the separation space and fill the vacant space.

The inner case 30 may be partitioned into a plurality of spaces having an open box shape, and may be divided into a refrigerator compartment 41 and a freezer compartment 42.

In the present disclosure, a double-door refrigerator, in which the refrigerator compartment 41 and the freezer compartment 42 are disposed side by side, is described as an example.

A door connects to the front surface of the cabinet 2, and opens and closes the refrigerator 1.

A first door 20*a* may be disposed on a front surface corresponding to the refrigerator compartment 41, and a second door 20*b* may be disposed on a front surface corresponding to the freezer compartment 42.

For example, the first door 20*a* and the second door 20*b* are rotary ones that have a rotation shaft respectively at both sides of the cabinet 2 and rotates around the rotation shaft.

A plurality of storage parts 51 and a plurality of shelf parts 52 may be provided in the refrigerator compartment 41 and the freezer compartment 42, and move to be drawn from or inserted into the refrigerator compartment 41 and the freezer compartment 42 in a sliding manner and accommodate and store a storage target easily.

The refrigerator compartment 41 and the freezer compartment 42 may be respectively provided with an additional temperature sensor, such that the temperatures of the refrigerator compartment 41 and the freezer compartment 42 are adjusted independently to allow the refrigerator compartment 41 and the freezer compartment 42 to have a different temperature.

[Coupling Relationship Among Flow Path Duct Assembly, Supply Duct Assembly and Grille Fan Assembly]

Figure 2:
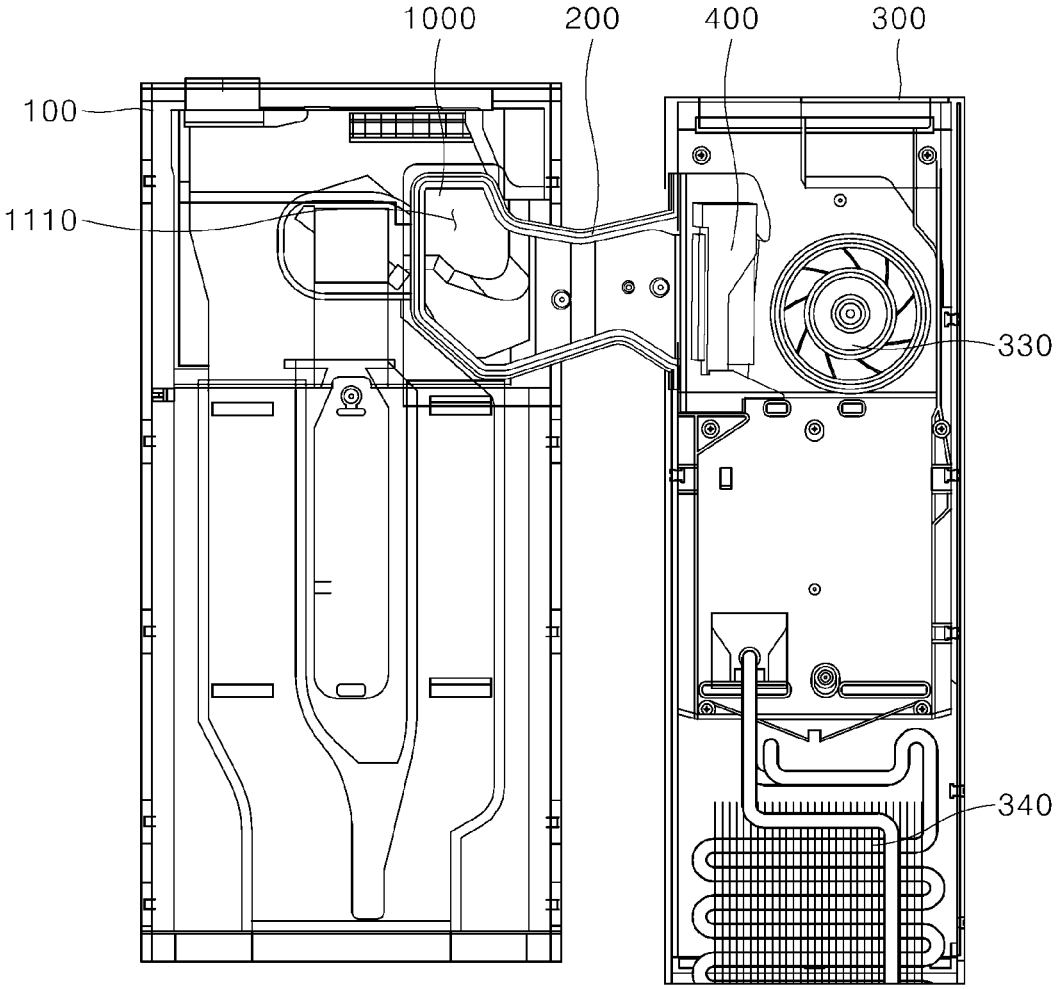
FIG. 2 is a rear view showing that a flow path duct assembly, a supply duct assembly and a grille fan assembly in one embodiment are coupled.

Hereafter, a coupling relationship among a flow path duct assembly, a supply duct assembly, and a grille fan assembly in one embodiment is described, with reference to FIGS. 1 and 2.

In the present disclosure, the terms such as one side and the other side may denote areas that are relatively close to the left side and the right side respectively, with respect to the rear surface of the refrigerator 1 as illustrated in FIG. 2.

In the present disclosure, the terms such as one side surface and the other side surface, and one side wall and the other side wall may be defined, in the same way that one side and the other side are defined.

The refrigerator compartment 41 may be disposed at one side of the freezer compartment 42, such that the refrigerator compartment 41 and the freezer compartment 42 are disposed side by side.

A flow path duct assembly 100, comprising a cold air flow path 1000 in which cold air flows, may be disposed at the rear of the refrigerator compartment 41.

The flow path duct assembly 100 may comprise a flow path duct cold air inlet 1110 that is formed in a way that the rear of the flow path duct cold air inlet 1110 is depressed and exposed, and cold air flowing into the flow path duct cold air inlet 1110 may flow in the flow path duct assembly 100 through a cold air flow path 1000 that communicates with the flow path duct cold air inlet 1110.

The flow path duct cold air inlet 1110 may be disposed in a relatively upper area, with respect to the central area of the flow path duct assembly 100, and may be disposed near the other side surface that is a side surface.

A grille fan assembly 300 may be disposed at the rear of the freezer compartment 42.

Accordingly, the flow path duct assembly 100 and the grille fan assembly 300 may be disposed side by side.

The grille fan assembly 300 may comprise an evaporator 340 generating cold air, and a fan module 330 that blows cold air generated from the evaporator 340.

For example, the evaporator 340 may be disposed in a relatively lower area, with respect to the central area of the grille fan assembly 300, and the fan module 330 may be disposed in an upper area with respect to the central area of the grille fan assembly 300. However, the positions of the evaporator 340 and the fan module 330 are not limited.

The cold air that is blown by the fan module 330 may be supplied to the freezer compartment 42 and the refrigerator compartment 41.

A supply duct assembly 200 may be disposed between the other side surface of the flow path duct assembly 100 and one side surface of the grille fan assembly 300, which are adjacent to each other.

One side of the supply duct assembly 200 may communicate with the flow path duct assembly 100, and the other side may communicate with the grille fan assembly 300.

Accordingly, the cold air that is blown by the fan module 330 of the grille fan assembly 300 may be supplied to the flow path duct assembly 100 through the supply duct assembly 200.

The grille fan assembly 300 may comprise a flow path opening and closing module 400 that selectively blocks the cold air which is supplied to the supply duct assembly 200.

The flow path opening and closing module 400 may be disposed to communicate with the other side of the supply duct assembly 200, at the rear of the freezer compartment 42, and adjust the amount of cold air, which is supplied to the refrigerator compartment 41 through the supply duct assembly 200, based on the opening and closing operations of the flow path opening and closing module 400.

[Flow Path Duct Assembly]

Hereafter, the flow path duct assembly 100 of one embodiment is described with further reference to FIGS. 3A to 5.

The flow path duct assembly 100 may comprise a flow path duct body part 110, a first flow path duct insulation part 120, a second flow path duct insulation part 130, a first flow path duct cover 140, and a second flow path duct cover 150.

The flow path duct body part 110 may comprise a cold air outlet that discharges cold air, flowing through the cold air flow path 1000 of the flow path duct assembly 100, into the refrigerator compartment 41.

For example, a first cold air outlet 1141 may be formed to face the front surface of the refrigerator compartment 41, in the upper area of the flow path duct body part 110.

Additionally, a first subsidiary cold air outlet 1141*a* may be formed in the upper area of the flow path duct body part 110, and spaced from, and disposed at one side of the first cold air outlet 1141.

For example, the first subsidiary cold air outlet 1141*a* may be formed to face upward, and an additional cold air discharge pipe, changing the direction of the flow of cold air, may connect to the first subsidiary cold air outlet 1141*a*, to supply the cold air to a desired area of the refrigerator compartment 41.

A plurality of second cold air outlets 1142 may be formed in the central area of the flow path duct body part 110, and a plurality of third cold air outlets 1143 may be formed in the lower area of the flow path duct body part 110, to supply cold air evenly to the entire refrigerator compartment 41.

A temperature sensor, an antibacterial filter, a lighting device and the like may be fixed to the flow path duct body part 110, and the user can recognize the flow path duct body part 110 from the front surface of the refrigerator compartment 41.

The first flow path duct insulation part 120 may be disposed on the rear surface of the flow path duct body part 110.

The first flow path duct insulation part 120 may be a component that forms a cold air flow path 1000 flowing in the flow path duct assembly 100.

The first flow path duct insulation part 120 may be made of an insulator material such as styrofoam, to reduce the effect of the cold air flowing in the cold air flow path 1000 on the refrigerator compartment 41.

The flow path duct cold air inlet 1110 into which cold air flows is depressed and formed at the other side of the upper area of the first flow path duct insulation part 120 and communicate with the cold air flow path 1000.

The flow path duct cold air inlet 1110 is open upward and closed downward. Accordingly, the cold air flow path 1000 starting from the flow path duct cold air inlet 1110 fluidly communicates with the upward direction.

The upward direction in the present disclosure is not limited to the perpendicular direction, and even if a direction is inclined to one side or the other side, the direction may also indicate the upward direction, in an inclined manner, with respect to the horizontal direction.

Likewise, the downward direction in the present disclosure is not limited to the perpendicular direction, and even if a direction is inclined to one side or the other side, the direction may also indicate the downward direction, in an inclined manner, with respect to the horizontal direction.

A first cold air guide part 1130 in an island shape may be disposed at one side of the flow path dust cold air inlet 1110 in contact with the first cold air guide part 1130.

The first cold air guide part 1130 may be disposed in the upper area of the first flow path duct insulation part 120 and spaced a predetermined distance apart from the upper side 101, the lower side 102, one side 103 and the other side 104 of the first flow path duct insulation part 120, to form a cold air flow path 1000 that guides cold air flowing into the flow path duct cold air inlet 1110.

A second cold air guide part 1150 looking like an island may be disposed below the first cold air guide part 1130.

The second cold air guide part 1150 may be elongated from the central area of the first flow path duct insulation part 120 to the lower area thereof and spaced a predetermined distance apart from the upper side 101, the lower side 102, one side 103 and the other side 104 of the first flow path duct insulation part 120, to form a cold air flow path 1000 that guides cold air guided by the first cold air guide part 1130.

A pair of cold air flow paths 1000 may be formed at both sides of the second cold air guide part 1150 and allow cold air to be branched and flow to both the sides.

The first cold air guide part 1130 and the second cold air guide part 1150 may have a predetermined thickness and protrude rearward, to form a cold air flow path 1000.

The second flow path duct insulation part 130 may be coupled to the rear surface of the first flow path duct insulation part 120, to form and seal a cold air flow path 1000.

For example, the second flow path duct insulation part 130 may be formed in a way that the second flow path duct insulation part 130 covers the first cold air guide part 1130 rather than the second cold air guide part 1150, and may seal a partial area of the cold air flow path 1000.

The area covered by the second flow path duct insulation part 130 is adjacent to the flow path duct cold air inlet 1110 into which cold air flows directly from the freezer compartment 42, the outer case 10 of the refrigerator 1 may be affected by the cold air.

To prevent this from happening, the second flow path duct insulation part 130 may be made of an insulation material such as styrofoam and have a predetermined thickness, like the first flow path duct insulation part 120.

Figure 3A:
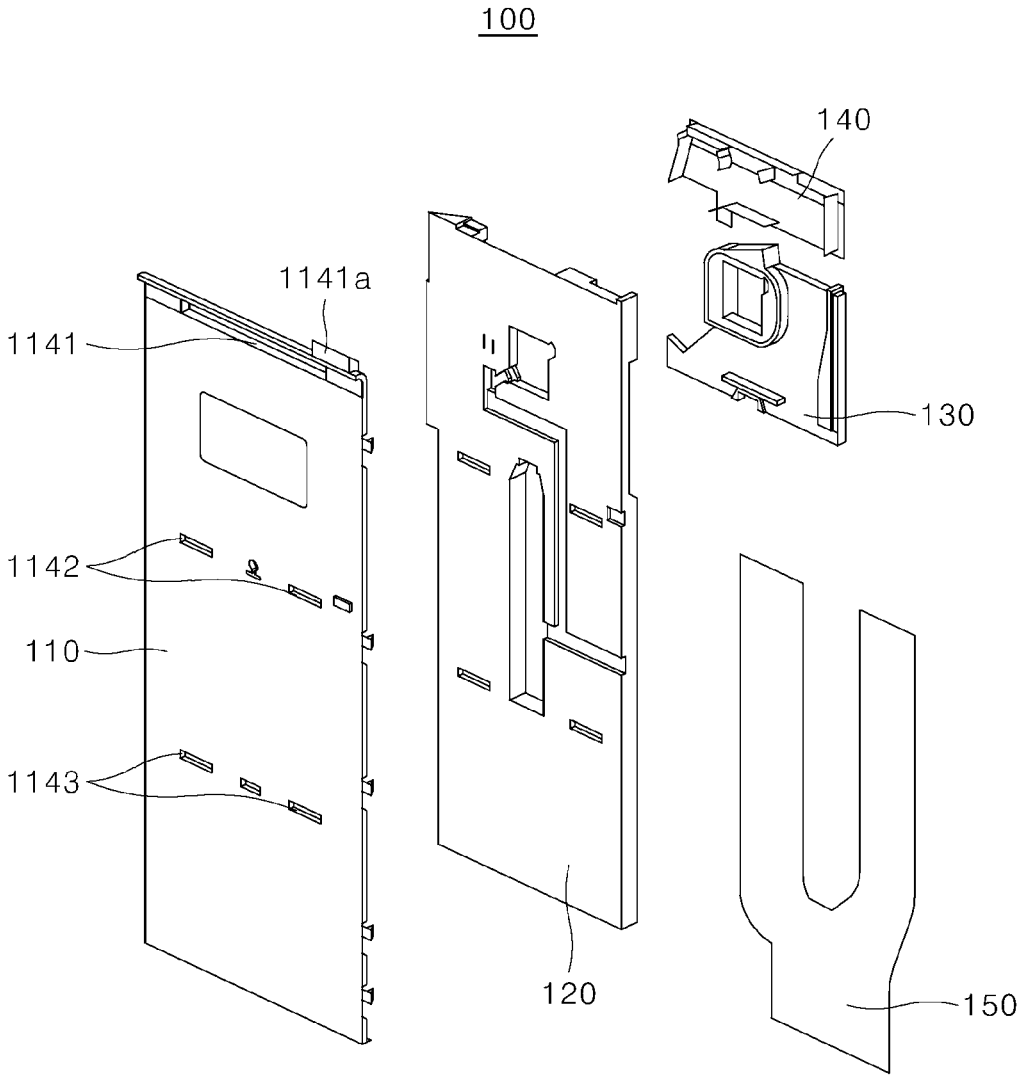
FIG. 3A is an exploded perspective view showing a flow path duct assembly viewed from the front thereof.
Figure 3B:
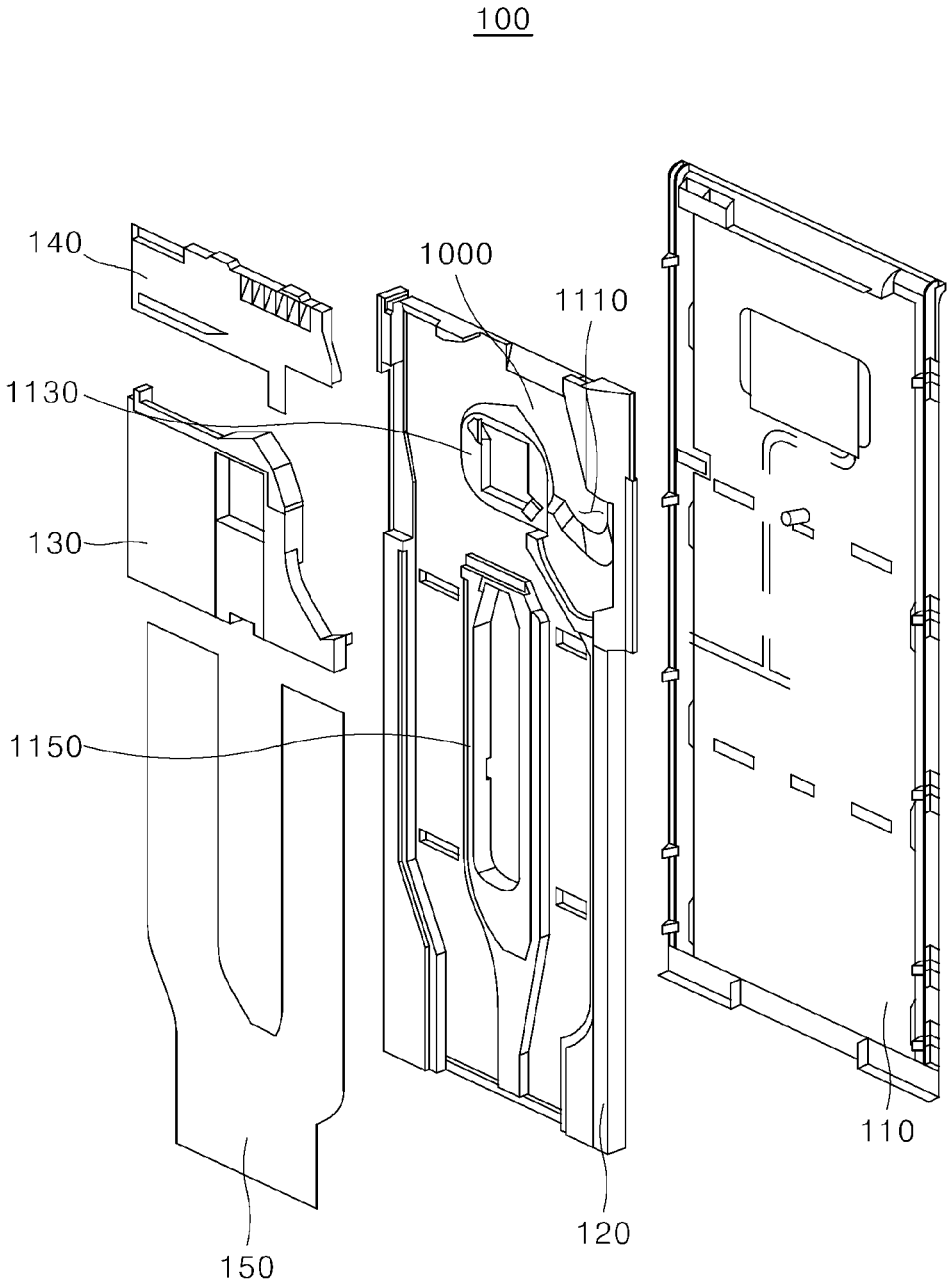
FIG. 3B is an exploded perspective view showing the flow path duct assembly viewed from the rear thereof.

Referring to FIGS. 3A and 3B, the second flow path duct insulation part 130 has a wall of a predetermined thickness, along the edge thereof, but is not limited.

For example, the wall may be formed at the first flow path duct insulation part 120 rather than the second flow path duct insulation part 130, to seal the cold air flow path 1000, since the first flow path duct insulation part 120 and the second flow path duct insulation part 130 are coupled to seal the cold air flow path 1000.

A first flow path duct cover 140 may be formed in the upper portion of the second flow path duct insulation part 130, and guide cold air to the first cold air outlet 1141 and the first subsidiary cold air outlet 1141*a* and seal the cold air flow path 1000.

Additionally, a second flow path duct cover 150 may be disposed in the lower portion of the second flow path duct insulation part 130, and have a shape corresponding to the shape of the cold air flow path 1000 at both the sides of the second cold air guide part 1150, to seal the cold air flow path 1000 in the middle area and the lower area of the second flow path duct insulation part 130.

Figure 4:
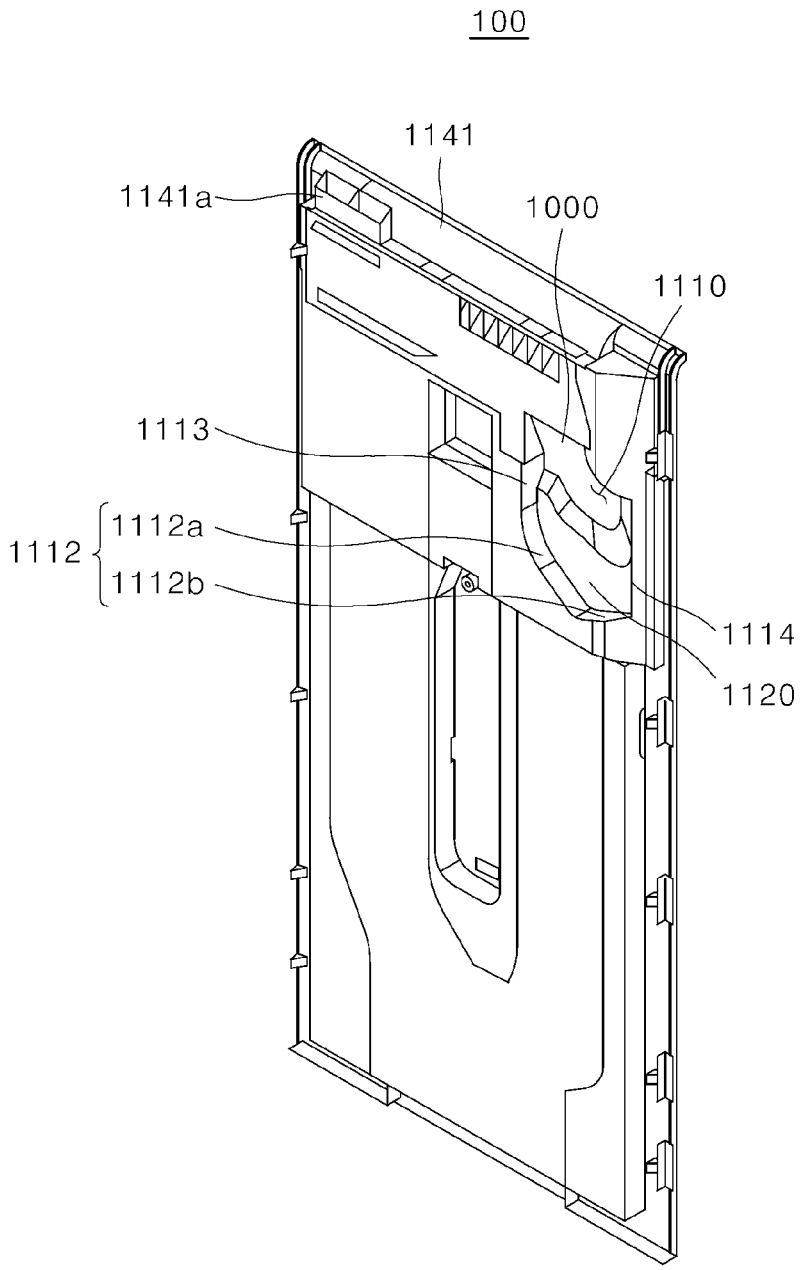
FIG. 4 is a rear perspective view showing a flow path duct assembly.
Figure 5:
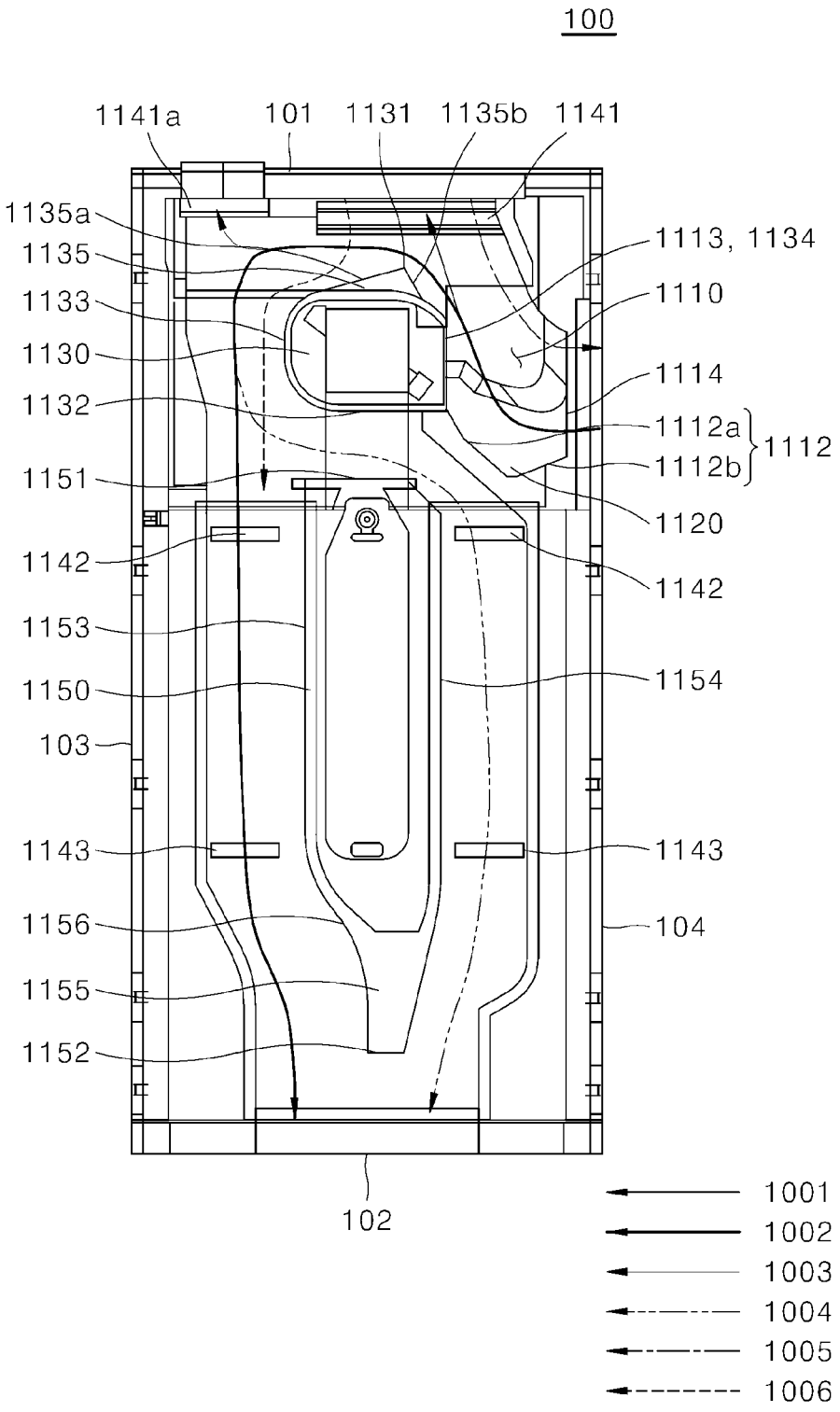
FIG. 5 is a rear view showing a cold air flow path of a flow path duct assembly.
Figure 6:
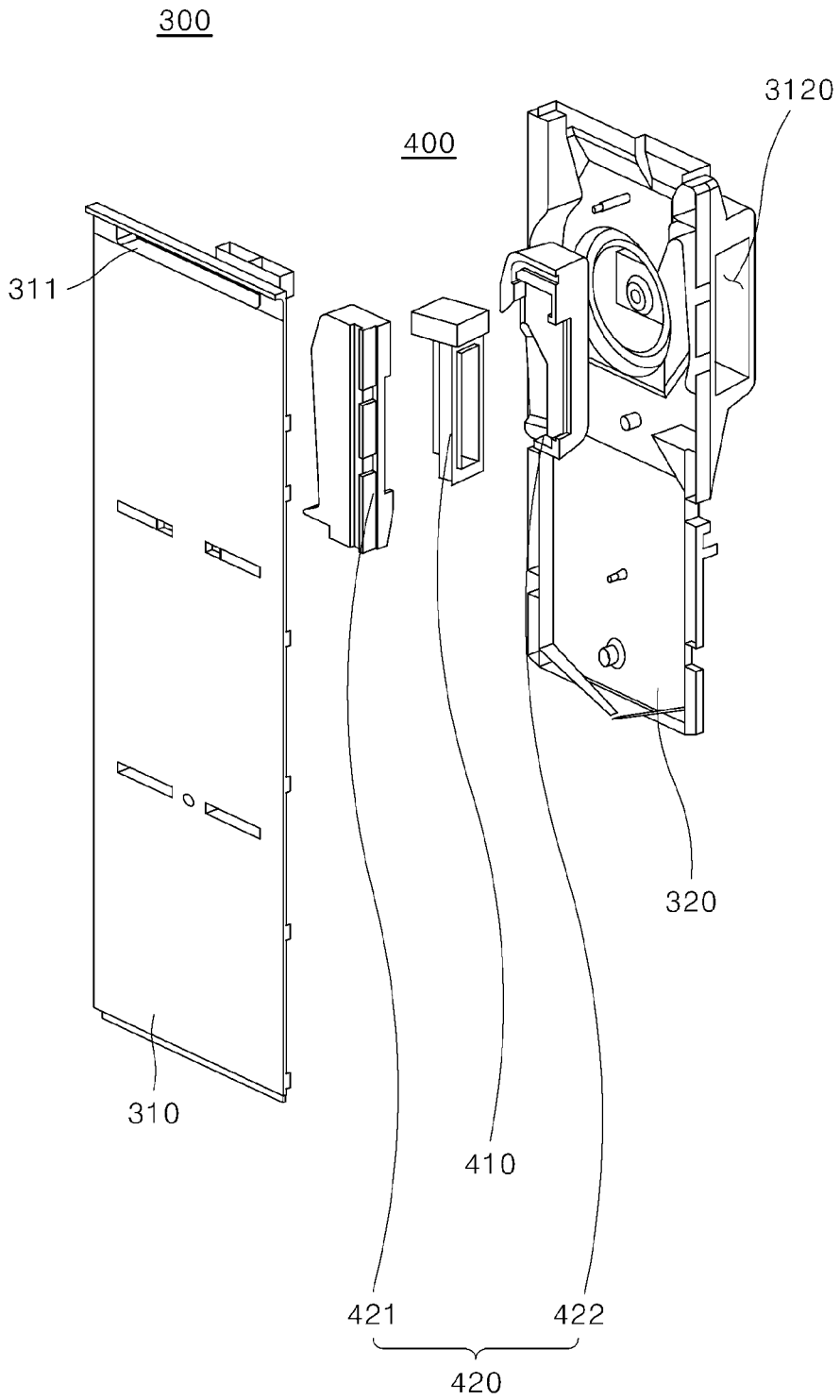
FIG. 6 is an exploded perspective view showing a grille fan assembly.

Referring to FIGS. 4 and 5, the flow path duct cold air inlet 1110 may be formed at the other side of the upper area of the flow path duct assembly 100, and an area of the flow path duct assembly 100, corresponding to the flow path duct cold air inlet 1110, may be formed as an open area that is exposed rearward.

Since the flow path duct cold air inlet 1110 communicates with the cold air flow path 1000, a portion of the cold air flow path 1000, exposed by the flow path duct cold air inlet 1110, may be exposed outward since the flow path duct cold air inlet 1110 communicates with the cold air flow path 1000.

At this time, the cold air flow path 1000, exposed by the flow path duct cold air inlet 1110, may be open in the upward direction of the flow path duct assembly 100 and closed in the downward direction of the flow path duct assembly 100.

Thus, cold air flowing into the flow path duct cold air inlet 1110 may flow in the upward direction, without flowing in the downward direction.

Since the cold air flow path 1000, exposed by the flow path duct cold air inlet 1110, is closed in the downward direction, the drooping of cold air may be prevented.

For example, in the case where cold air continues to flow into the flow path duct cold air inlet 1110, the upward flow of the cold air may help to prevent humid air of the refrigerator compartment 41 from reversely flowing through the first cold air outlet 1141.

If the flow of cold air into the flow path duct cold air inlet 1110 is blocked, the upward flow of the cold air stops. Accordingly, the humid air of the refrigerator compartment 41 may flow reversely through the first cold air outlet 1141, based on natural convection.

At this time, if the cold air flow path 1000, exposed by the flow path duct cold air inlet 1110, is also open in the downward direction, the drooping of the cold air may occur, and the cold air may escape in the downward direction.

If the drooping of cold air occurs, humid air may flow into a vacant space of the flow path duct cold air inlet 1110, and the humid air flowing reversely may be attached to the supply duct assembly 200 and the flow path opening and closing module 400 that fluidly communicate with the flow path duct cold air inlet 1110, and may form ice.

In the present disclosure, since the cold air flow path 1000, exposed by the flow path duct cold air inlet 1110 of the flow path duct assembly 100, is open in the upward direction and closed in the downward direction, the drooping of cold air may be prevented, and the flow of humid air into the vacant space, caused by the drooping of cold air, may be suppressed.

The flow path duct cold air inlet 1110 may be surrounded by a lower side wall 1112 comprising a first inclination wall 1112*a* and a second inclination wall 1112*b* that protrude in the downward direction, one side wall 1113 extending from one side of the first inclination wall 1112*a* in the upward direction, and the other side wall 1114 extending from the other side of the second inclination wall 1112*b* in the upward direction.

The first inclination wall 1112*a* may be disposed near one side of the flow path duct assembly 100, and the second inclination wall 1112*b* may be disposed near the other side of the flow path duct assembly 100.

The first inclination wall 1112*a* may incline to face the other side wall 1114.

Thus, the open area of the flow path duct cold air inlet 1110 may decrease from the other side of the first inclination wall 1112*a* further toward one side of the first inclination wall 1112*a*.

As described above, the first inclination wall 1112*a* may be formed at the lower side of the flow path duct cold air inlet 1110, and function as a structure part for preventing the drooping of cold air, such that the occurrence of the drooping of cold air decreases further at the flow path duct cold air inlet 1110.

Unlike the first inclination wall 1112*a*, the second inclination wall 1112*b* may incline to face one side wall 1113.

Thus, the open area of the flow path duct cold air inlet 1110 may increase from the other side of the second inclination wall 1112*b* further toward one side of the second inclination wall 1112*b*.

The inclination angle of the second inclination wall 1112*b* may allow cold air to smoothly flow to the first inclination wall 1112*a* that functions as a structure part for preventing the drooping of cold air.

Additionally, the second inclination wall 1112*b* may guide defrost water to allow the defrost water to escape in the downward direction if the defrost water is generated.

The flow path duct assembly 100 may further comprise a step part 1120 that is disposed in the lower area of the flow path duct cold air inlet 1110.

The step part 1120 may contact the lower side wall 1112 of the flow path duct cold air inlet 1110, and have a predetermined thickness to contact a portion of one side wall 1113 and the other side wall 1114 up to a certain height.

For example, the thickness of the step part 1120 may be less than the thicknesses of the lower side wall 1112, one side wall 1113 and the other side wall 1114.

The upper side portion of the step part 1120 may have an inclination surface that faces in the upward direction, to guide and allow cold air, flowing into the flow path duct cold air inlet 1110, to flow to the cold air flow path 1000 disposed in the upward direction of the flow path duct cold air inlet 1110.

The first cold air guide part 1130 may be disposed at one side of the flow path duct cold air inlet 1110, and form a cold air flow path 1000 guiding cold air.

The first cold air guide part 1130 and the flow path duct cold air inlet 1110 may be adjacent to each other to share a boundary.

For example, the other side wall 1134 of the first cold air guide part 1130 may be one side wall 1113 of the flow path duct cold air inlet 1110.

Accordingly, cold air having flown into the flow path duct cold air inlet 1110 may not flow downward along the other side wall 1134 of the first cold air guide part 1130, but flow upward.

The upper side wall 1131, one side wall 1133 and the lower side wall 1132 of the first cold air guide part 1130 may form a space that is spaced from the upper side 101, one side 103 and the lower side 102 of the flow path duct assembly 100, to form a cold air flow path 1000.

Accordingly, cold air having flown into the flow path duct cold air inlet 1110 may flow counterclockwise along the other side wall 1134, the upper side wall 1131, one side wall 1133 and the lower side wall 1132 of the first cold air guide part 1130.

The first cold air outlet 1141 and the first subsidiary cold air outlet 1141*a*, which supply cold air to the refrigerator compartment 41, are disposed above the first cold air guide part 1130 and the flow path duct cold air inlet 1110 and spaced from each other, such that the cold air flow path 1000 is formed in the separation space between the first cold air outlet 1141 and the first subsidiary cold air outlet 1141*a*.

The second cold air guide part 1150 looking like an island may be formed and spaced below the first cold air guide part 1130, and form a cold air flow path 1000.

The cold air flow path in the present disclosure denotes a main passage of cold air, through which cold air flows, and cold air may flow in another cold air flow path as well as the cold air flow path described in the disclosure.

Accordingly, the flow of cold air should not be interpreted as flowing only in the cold air flow path of the present disclosure.

The cold air flow path 1000 of the flow path duct assembly 100 may comprise one or more of the following cold air flow paths.

A first cold air flow path 1001 may be formed, and cold air having flown into the flow path duct cold air inlet 1110 may flow to the first cold air outlet 1141 along the other side wall 1134 of the first cold air guide part 1130 through the first cold air flow path 1001.

Cold air passing through the first cold air flow path 1001 may be supplied to the upper area of the refrigerator compartment 41 through the first cold air outlet 1141, and adjust the temperature of the refrigerator compartment 41.

Additionally, a second cold air flow path 1002 may be branched from the first cold air flow path 1001, to allow cold air to flow along the upper side wall 1131 and one side wall 1133 of the first cold air guide part 1130 and along one side wall 1153 of the second cold air guide part 1150.

The second cold air flow path 1002 may have a second cold air outlet 1142 and a third cold air outlet 1143, to supply cold air to the central area and the lower area of the refrigerator compartment 41.

Additionally, a third cold flow path 1003 may be branched from the second cold air flow path 1002, to allow cold air to flow to the first subsidiary cold air outlet 1141*a* that is disposed at one side of the first cold air outlet 1141.

Cold air passing through the third cold air flow path 1003 may be supplied to the upper area of the refrigerator compartment 41 through the first subsidiary cold air outlet 1141*a*, and adjust the temperature of the refrigerator compartment 41.

Further, a fourth cold air flow path 1004 may be branched from the second cold air flow path 1002, to allow cold air to flow along the other side wall 1154 of the second cold air guide part 1150.

The fourth cold air flow path 1004 may have a second cold air outlet 1142 and a third cold air outlet 1143, and supply cold air to the central area and the lower area of the refrigerator compartment 41.

The fourth cold air flow path 1004 may be branched from the second cold air flow path 1002, and be closer to the freezer compartment 42 than the second cold air flow path 1002.

Accordingly, the cold air flow path 1000 is formed such that the flux of cold air passing through the second cold air flow path 1002 may be greater than the flux of cold air passing through the fourth cold air flow path 1004 that is disposed near the freezer compartment 42, thereby ensuring a balance of cold air in the entire refrigerator 1.

Thus, the flux of cold air flowing along the one side wall 1153 of the second cold air guide part 1150 may be greater than the flux of cold air flowing along the other side wall 1154 of the second cold air guide part 1150.

However, since the amounts of cold air flowing at both sides with respect to the second cold air guide part 1150 differ, a reverse flow of cold air in the upward direction of the fourth cold air flow path 1004 may occur in the lower area of the second cold air guide part 1150, where the second cold air flow path 1002 and the fourth cold air flow path 1004 combine.

To prevent this from happening, a lower side extension part 1155 may be formed at the lower side of the second cold air guide part 1150, and the width of the lower side extension part 1155 may decrease further toward the downward direction.

At this time, since the curvature center of one side of the lower side extension part 1155, which is passed by the second cold air flow path 1002, comprises a curved surface part 1156 disposed in the direction of one side of the flow path duct assembly 100, cold air passing through the second cold air flow path 1002 may be guided in the downward direction rather than the direction of the fourth cold air flow path 1004.

Accordingly, the lower side extension part 1155 formed at the lower side of the second cold air guide part 1150 may reduce the reverse flow of cold air to the fourth cold air flow path 1004 at a maximum level, and guide cold air of the second cold air flow path 1002 in the downward direction.

The first cold air outlet 1141 may be disposed to overlap the first cold air guide part 1130 and the flow path duct cold air inlet 1110, in the up-down direction.

Thus, the cold air having flown into the flow path duct cold air inlet 1110 may be guided to easily flow to the first cold air outlet 1141.

Additionally, the first cold air guide part 1130 may comprise a subsidiary cold air guide part 1135, at the upper side thereof, and the subsidiary cold air guide part 1135 may comprise a third inclination wall 1135*a* and a fourth inclination wall 1135*b* that protrude upward.

At this time, the fourth inclination wall 1135*b* may be disposed closer to the flow path duct cold air inlet 1110 than the third inclination wall 1135*a*, and the third inclination wall 1135*a* may have a longer side than the fourth inclination wall 1135*b*.

Since the subsidiary cold air guide part 1135 is formed at the upper side of the first cold air guide part 1130 as described above, the subsidiary cold air guide part 1135 may guide the flow direction of cold air flowing reversely from the first cold air outlet 1141, and adjust the flux of the cold air.

For example, if humid air of the refrigerator compartment 41 flows reversely through the first cold air outlet 1141, the humid air may be branched into a first reversely flowing cold air 1005 flowing along the fourth inclination wall 1135*b*, and a second reversely flowing cold air 1006 flowing along the third inclination wall.

Since the first reversely flowing cold air 1005 may flow to the supply duct assembly 200 communicating with the flow path duct cold air inlet 1110, and form ice at the supply duct assembly 200, it is preferable to reduce the amount of the first reversely flowing cold air 1005 at a maximum level.

Accordingly, the subsidiary cold air guide part 1135 may be disposed to overlap the first cold air outlet 1141 in the up-down direction, and the length of the third inclination wall 1135*a* may be greater than the length of the fourth inclination wall 1135*b*, to increase the surface area in which cold air flowing reversely contacts with the third inclination wall 1135*a* rather than the fourth inclination wall 1135*b*.

Accordingly, the humid air reversely flowing from the first cold air outlet 1141 may be guided to flow in a direction opposite to the direction of the flow path duct cold air inlet 1110 as much as possible, such that the flow of the humid air to the supply duct assembly 200 is suppressed.

That is, the subsidiary cold air guide part 1135 may increase the amount of the second reversely flowing cold air 1006, to decrease the amount of the first reversely flowing cold air 1005 that is the humid air reversely flowing to the supply duct assembly 200.

Further, the subsidiary cold air guide part 1135 may guide defrost water, such that the defrost water escapes in the downward direction.

Since the third inclination wall 1135*a* has along side, a surface area of contact between the third inclination wall 1135*a* and the defrost water is greater than a surface area of contact between the fourth inclination wall 1135*b* and the defrost water, most of the defrost water may escape along the third inclination wall 1135*a* in the downward direction.

Thus, the amount of defrost water escaping along the fourth inclination wall 1135*b* in the direction of the supply duct assembly 200 may decrease, and the ice formation of the defrost water may decrease in the supply duct assembly 200.

[Grille Fan Assembly and Flow Path Opening and Closing Module]

Hereafter, a grille fan assembly 300 and a flow path opening and closing module 400 in one embodiment are described with reference to FIGS. 6 to 12.

The grille fan assembly 300 may comprise a shroud 320 and a grille fan 310.

The shroud 320 ma form the exterior of the rear side of the grille fan assembly 300, and the grille fan 310 may form the exterior of the front side of the grille fan assembly 300.

Referring further to FIG. 2, cold air that exchanges heat with the evaporator 340 while the cold air passes through the evaporator 340 may flow into a space between the shroud 320 and the grille fan 310 through the fan module 330, and the cold air having flown into the space may be supplied to the freezer compartment 42 through a freezer compartment cold air outlet 311 that is formed at the grille fan 310.

Additionally, the cold air having flown into the space between the shroud 320 and the grille fan 310 through the fan module 330 may fluidly communicate with the supply duct assembly 200 through a grille fan cold air outlet 3120 that is formed at one side of the shroud 320.

It is determined whether to supply cold air to the supply duct assembly 200, based on the opening and closing of the flow path opening and closing module 400.

The flow path opening and closing module 400 may comprise a damper 410 that selectively blocks cold air being supplied to the supply duct assembly 200, and a damper cover 420 that surrounds the damper 410.

The damper cover 420 may be comprised of a first damper cover 421 and a second damper cover 422 that respectively surround one side and the other side of the damper 410.

Figure 7A:
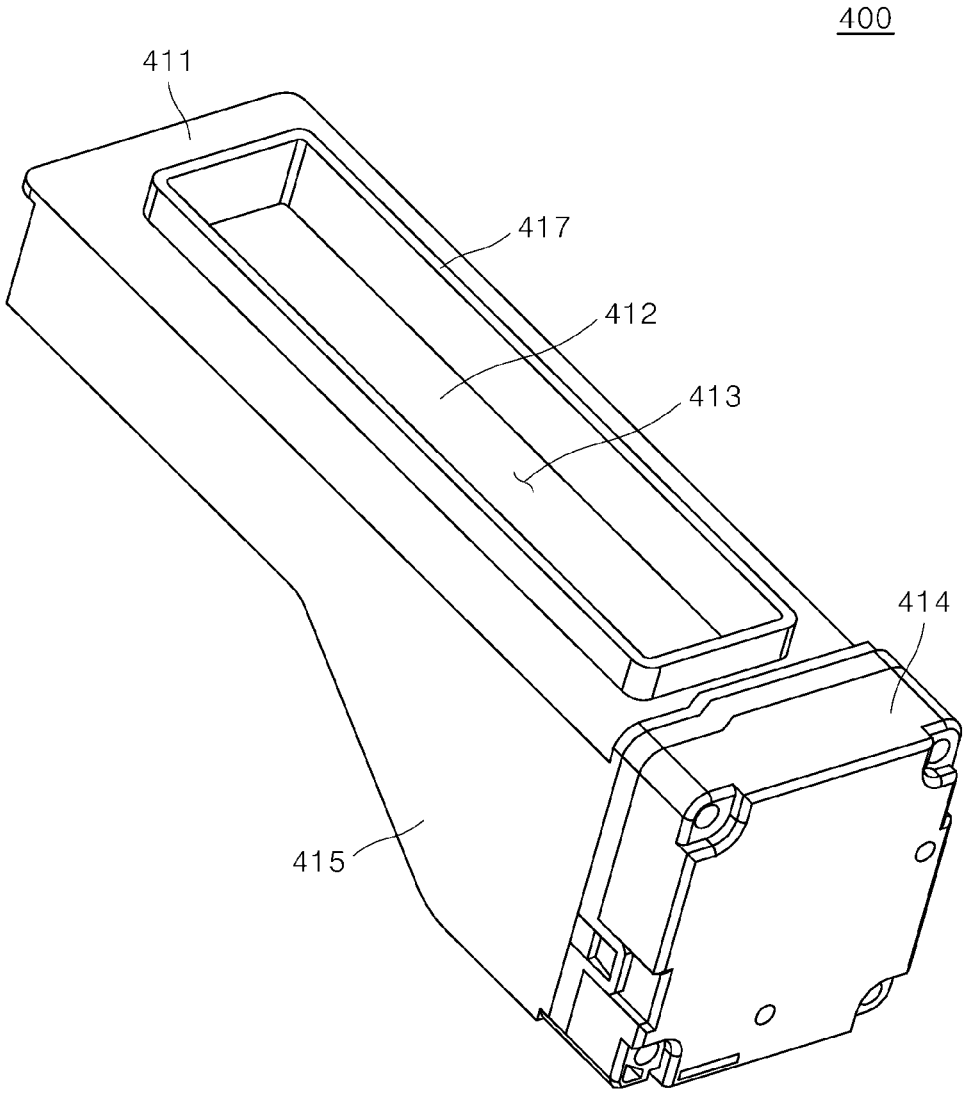
FIGS. 7A and 7B are perspective views showing that the damper door of a damper is open and closed, respectively.
Figure 7B:
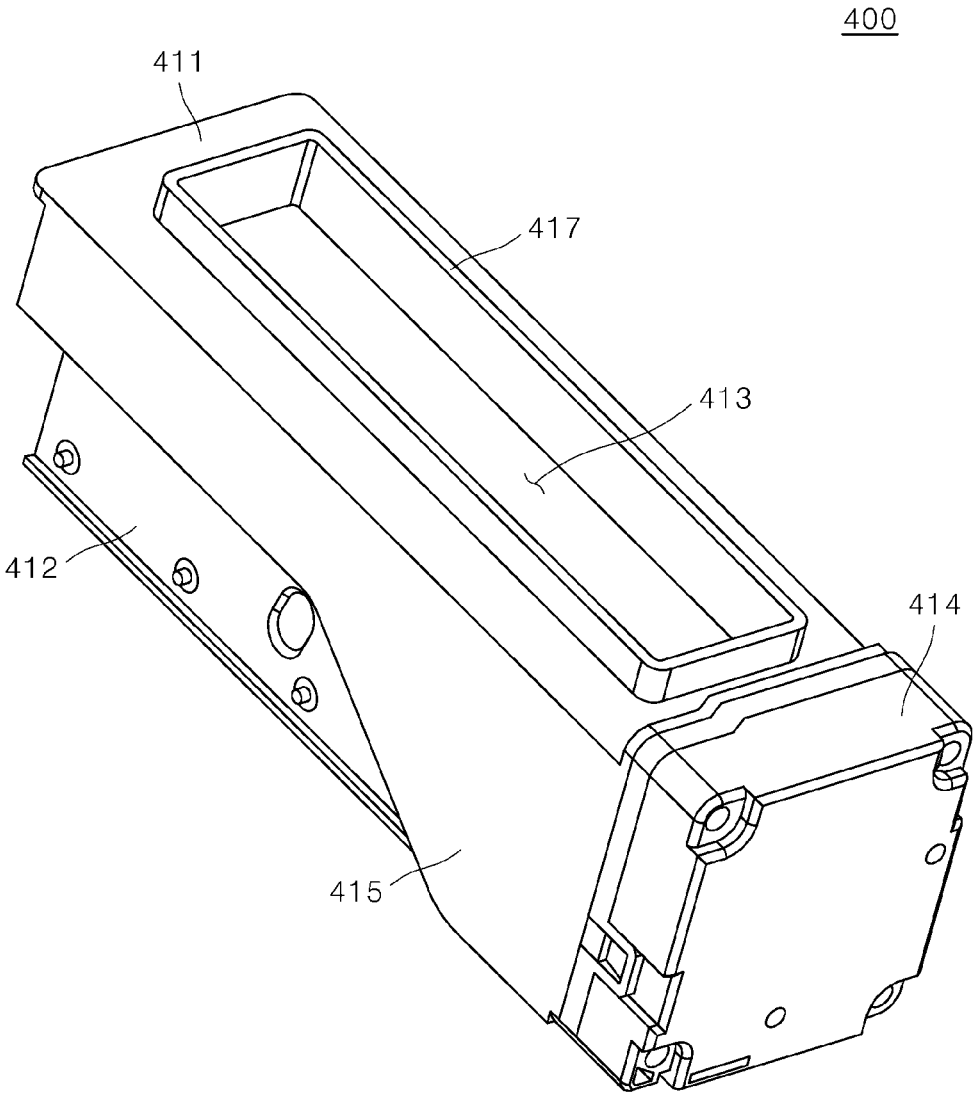

Referring to FIGS. 7A and 7B, the damper 410 may comprise a damper case 411, a damper door 412 and a damper operation motor 414.

The damper case 411 may be formed into a rectangular frame that has a damper passage hole 413 through which cold air toward the refrigerator compartment 41 passes, in the central portion thereof.

The damper passage hole 413 may be formed to communicate with the cold air flow path of the supply duct assembly 200 toward the refrigerator compartment 41.

Since the damper door 412 may be disposed on one surface of the damper case 411, one surface of the damper case 411 may have a flat surface shape to be coupled to the damper door 412 in contact with the damper door 412.

A damper mounting guide part 417 may be formed on the other surface of the damper case 411, and extend along the damper passage hole 413 in the upward direction.

The damper mounting guide part 417 may guide the direction of cold air passing through the damper passage hole 413.

A damper blocking part 415 may be formed on one surface of the damper case 411.

The damper blocking part 415 may adjust a rotation angle of the damper door 412, such that the damper door 412 is not open excessively.

The damper blocking part 415 may be formed in a way that a partial area of the damper blocking part 415 extends along the edge of one surface of the damper case 411.

The damper blocking part 415 may be disposed in the direction where the damper door 412 rotates, and block an excessive rotation of the damper door 412.

Figure 9A:
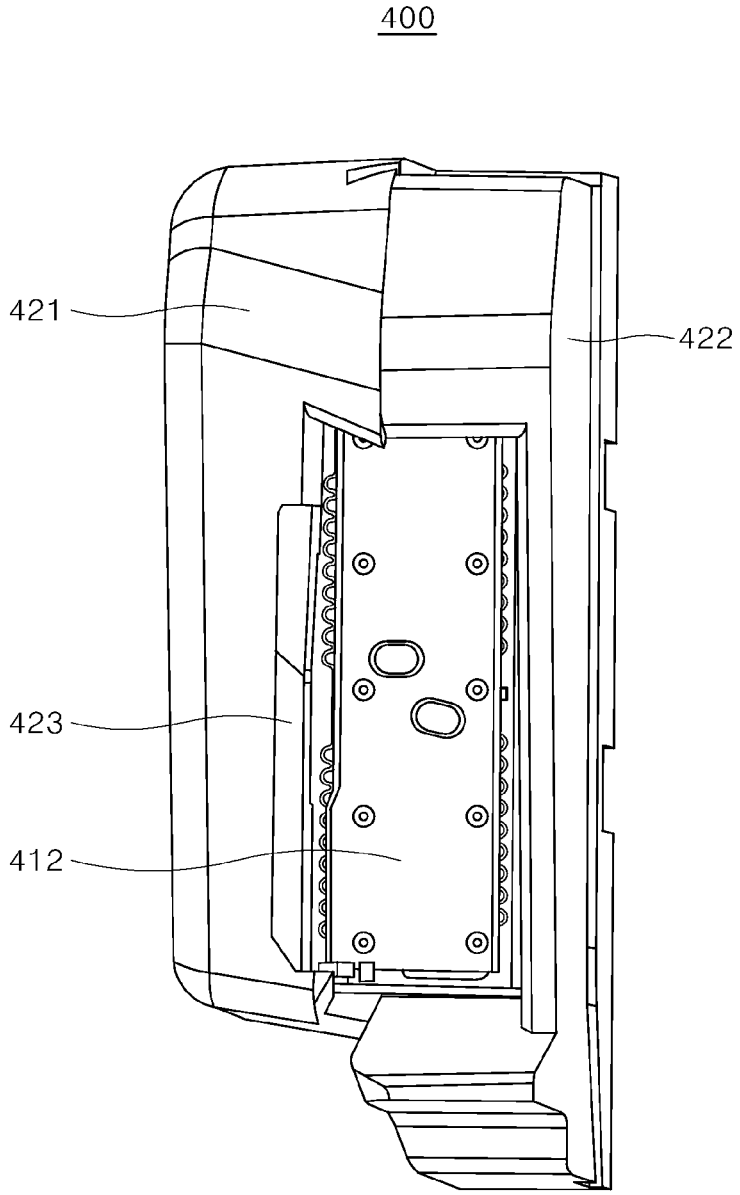
FIGS. 9A and 9B are views showing a flow path opening and closing module that is viewed in the direction in which cold air is drawn, with the damper door open and closed, respectively.
Figure 9B:
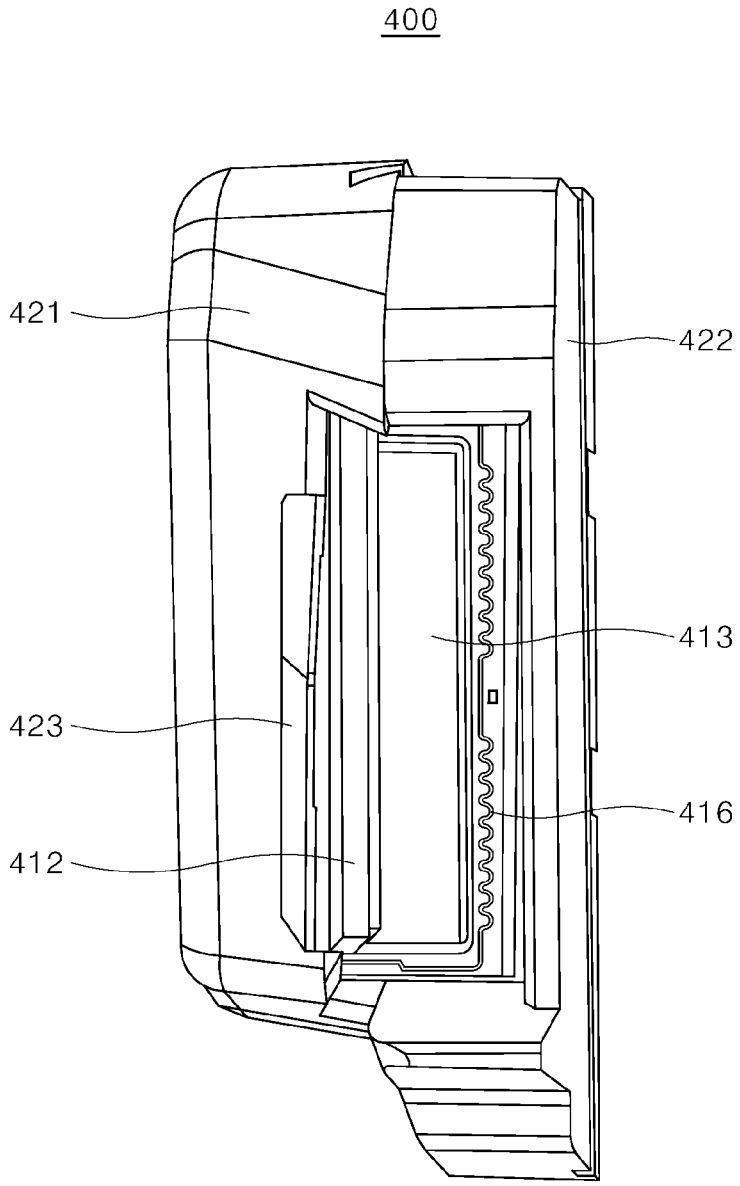

Referring further to FIGS. 9A and 9B, a damper hot wire 416 may be formed on one surface of the damper case 411, along the perimeter of the damper passage hole 413.

To increase the surface area where the damper hot wire 416 is formed, the damper hot wire 416 may have a pattern that comprises a maximum number of curved parts.

The position in which the damper hot wire 416 is formed may be an area where the damper case 411 and the damper door 412 contact each other directly.

The damper door 412 may not operate properly if the damper door 412 of the damper 410 is frozen.

The damper door 412 may be frozen in the portion where the damper door 412 contacts the damper case 411. Accordingly, if the damper door 412 does not operate due to ice formation, the problem of ice formation may be solved based on a defrosting process in which heat is applied to the damper hot wire 416.

The damper door 412 may be disposed on one surface of the damper case 411.

The damper door 412 may selectively block the passage of cold air through the damper passage hole 413.

To block cold air, the damper door 412 may contact one surface of the damper case 411 and block the damper passage hole 413, and to allow cold air to pass, the damper door 412 may rotate in one direction and open the damper passage hole 413.

The damper door 412 may have a larger surface are than the damper passage hole 413 such that the edge of the damper door 412 contacts the damper case 411, and when the damper door 412 is closed, the damper door 412 may block cold air effectively.

The damper operation motor 414 may be disposed at one side of the damper case 411.

The damper operation motor 414 may control whether the damper door 412 rotates.

The motor shaft of the damper operation motor 414 may be shaft-coupled to the rotation hinge shaft of the damper door 412, and control the rotation of the damper door 412.

Figure 10:
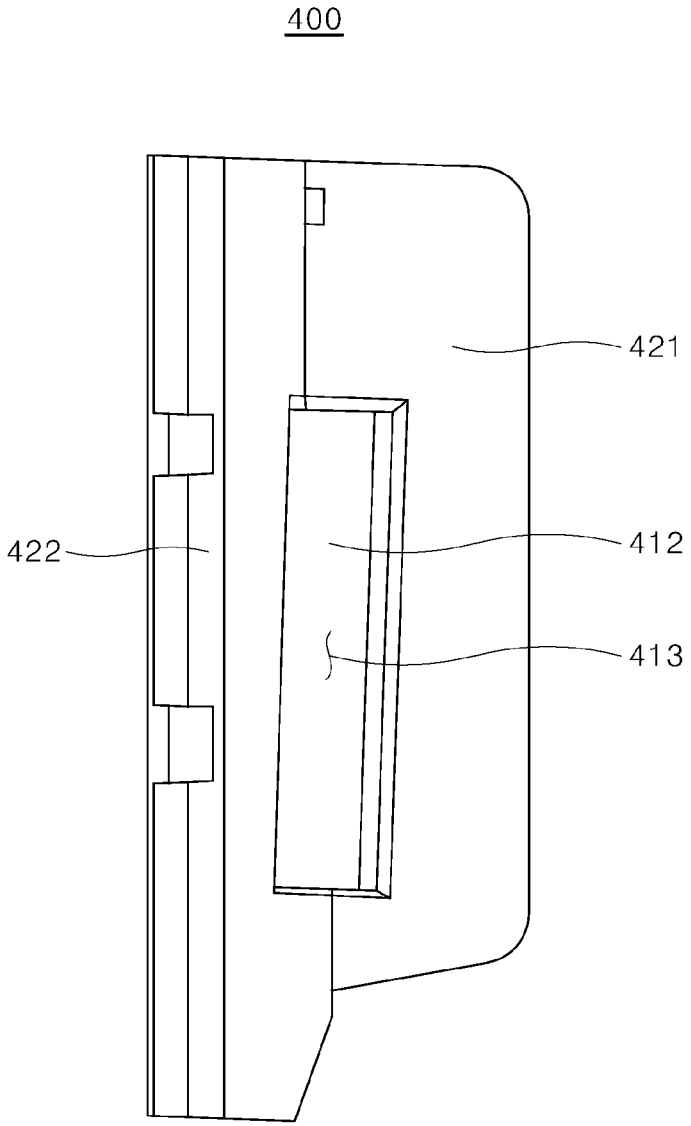
FIG. 10 is a view showing a flow path opening and closing module that is viewed in the direction in which cold air is discharged, with the damper door of the flow path opening and closing module closed.

FIG. 10 is a view showing the flow path opening and closing module 400 viewed, with the damper door 412 of the flow path opening and closing module 400 closed, in the direction where cold air is discharged.

That is, one surface of the damper case 411 may be disposed to face the inside of the grille fan assembly 300, and the damper door 412 may be open toward the inside of the grille fan assembly 300, such that the surface of an outwardly exposed portion of the damper door 412 decreases.

As shown in FIG. 10, a portion of the damper door 412 may only be exposed in the direction where the damper door 412 fluidly communicates with the supply duct assembly 200, such that the surface area of an injection molded product vulnerable to cold air decreases. Thus, the possibility of ice formation of the damper door 412 may decrease.

Figure 8:
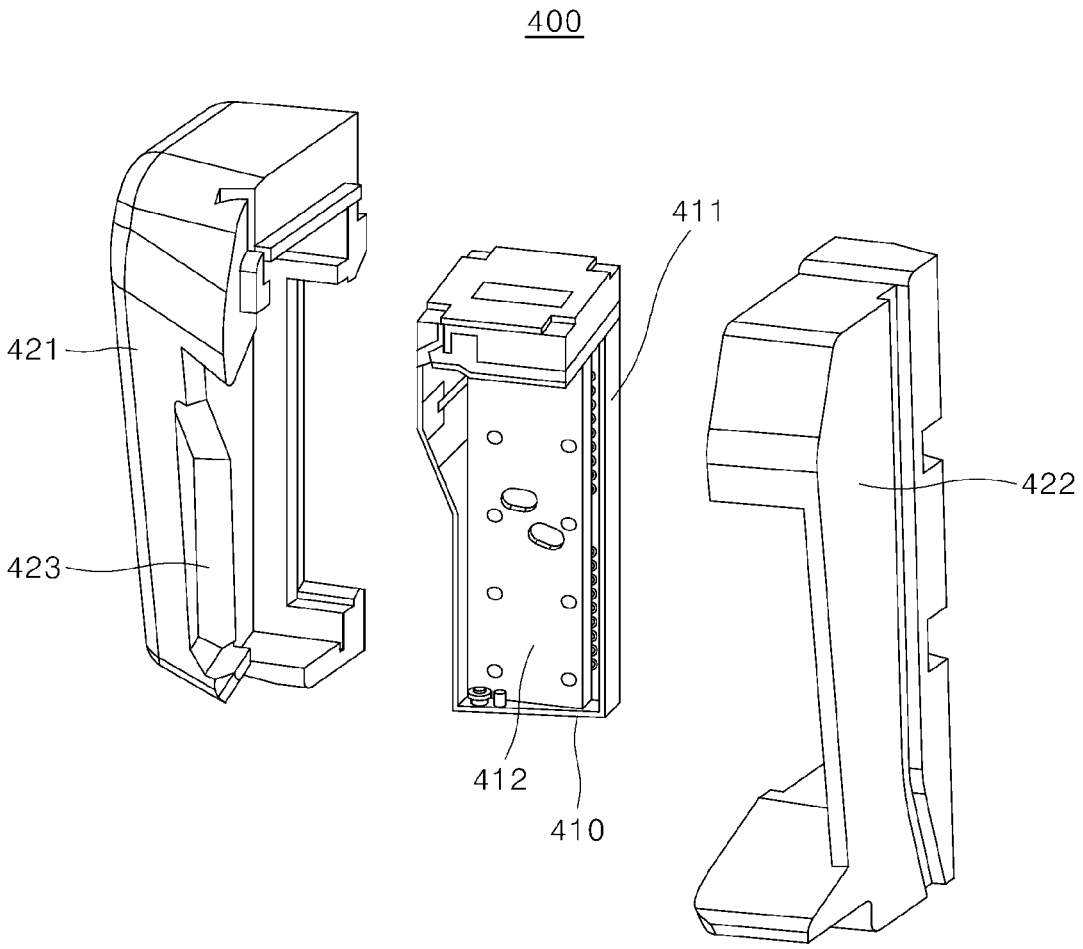
FIG. 8 is an exploded perspective view showing a flow path opening and closing module.

Referring to FIGS. 8, 9*a* and 9*b*, the damper door 412 is open in the direction where the first damper cover 421 is disposed, and the first damper cover 421 may comprise a damper cover step part 423 that is disposed to overlap at least a portion of the damper door 412 when the damper door 412 is open.

The damper cover step part 423 may be an area where a partial area of the first damper cover 421 is removed, and have a cold air flow path such that a portion of cold air flows through the damper cover step part 423.

Figure 12:
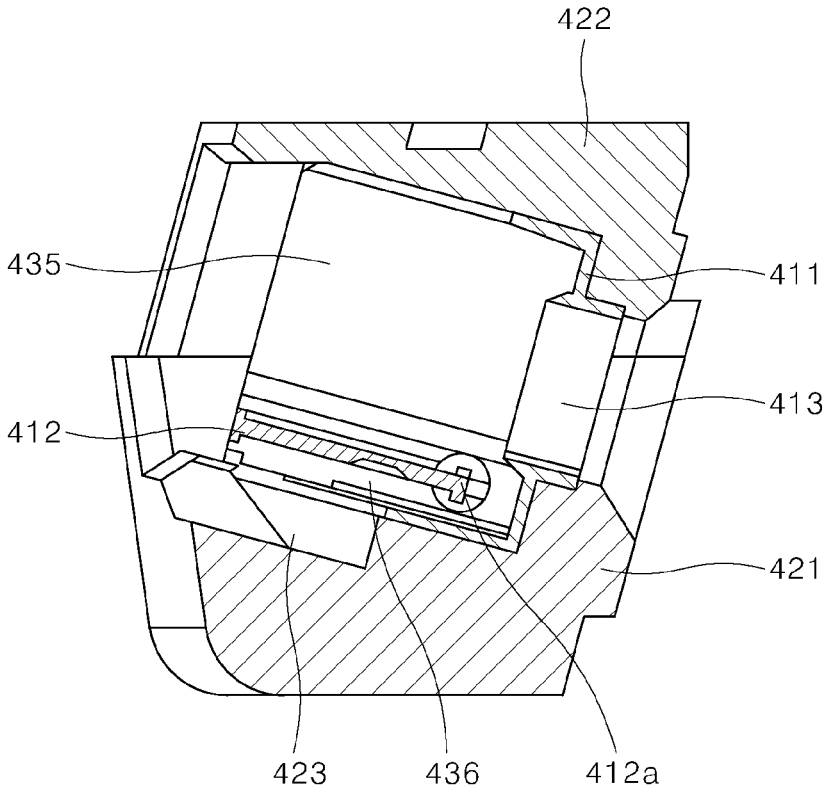
FIG. 12 is a cross-sectional view showing a cold air flow path in which cold air flows, with the damper door of the flow path opening and closing module open.
Figure 13:
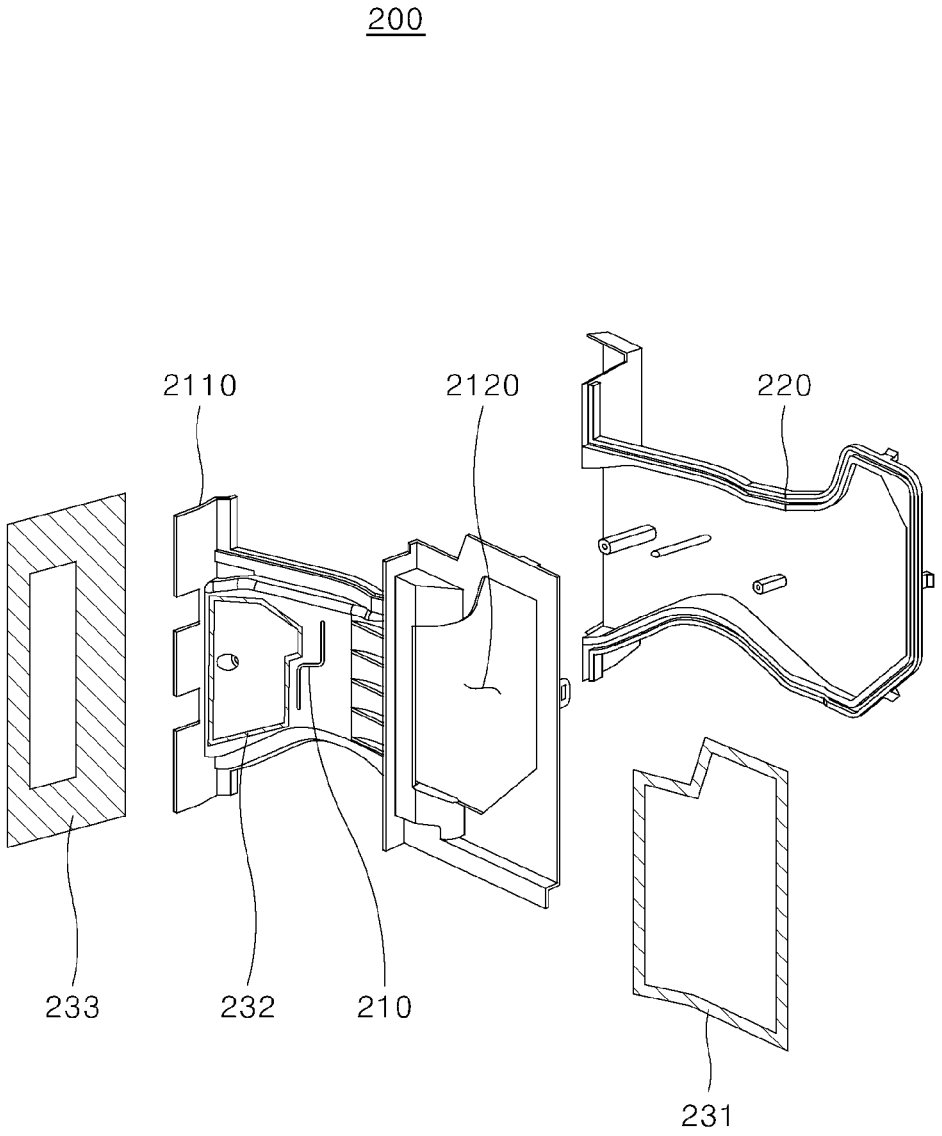
FIG. 13 is an exploded perspective view showing a supply duct assembly.
Figure 14:
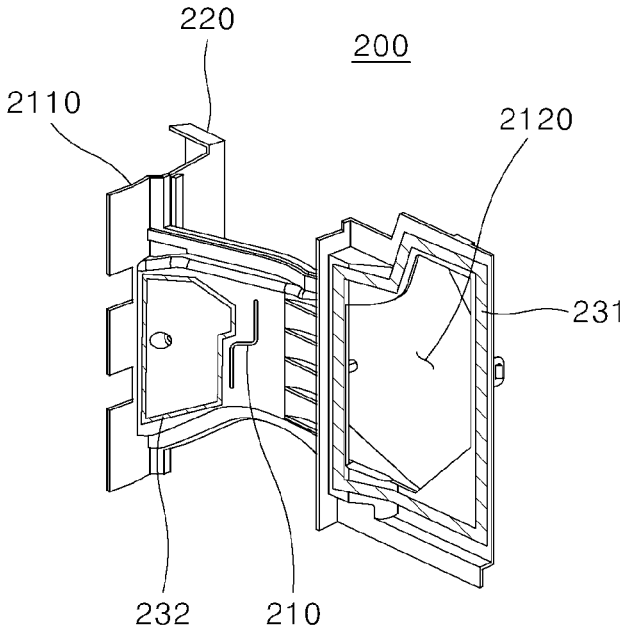
FIG. 14 is a perspective view showing a supply duct assembly.
Figure 15:
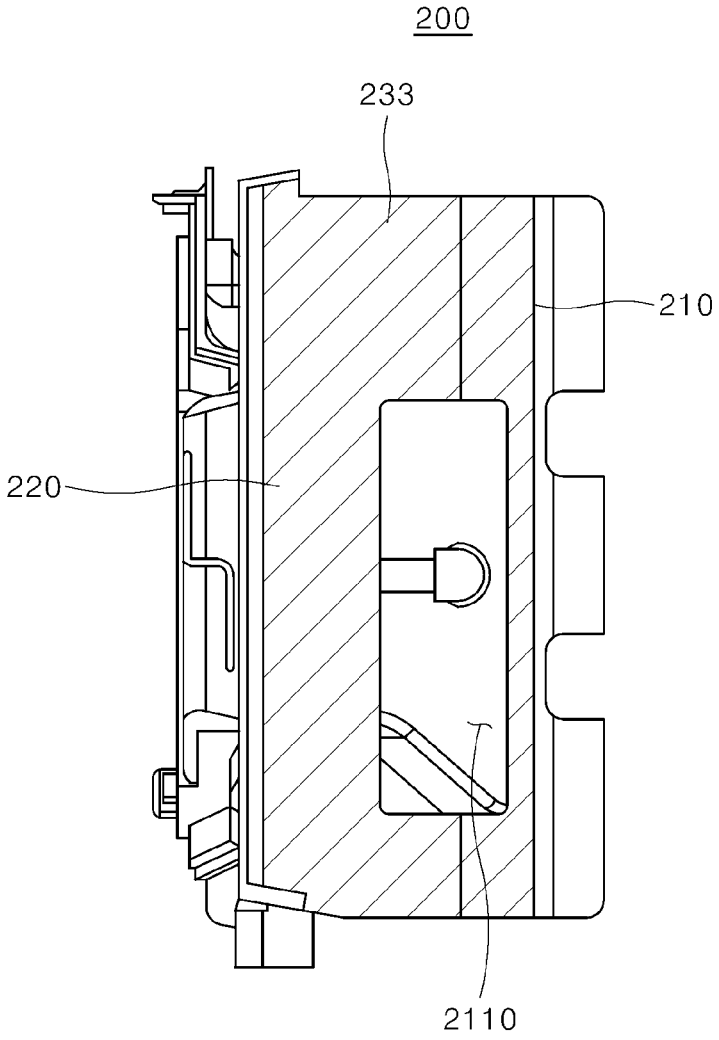
FIG. 15 is a view showing a view in the direction in which a supply duct cold air inlet of the supply duct assembly is exposed.

FIG. 12 is a cross-sectional view showing a cold air flow path in which cold air flows, with the damper door 412 of the flow path opening and closing module 400 open.

Since a damper door rotation shaft 412*a* of the damper door 412 is disposed near the first damper cover 421, the damper door rotation shaft 412*a* may be fixed to the first damper cover 421 in a way that the damper door rotation shaft 412*a* is adjacent to the first damper cover 421, when the damper door 412 is open.

Cold air that is blown from the grille fan assembly 300 may flow to a fifth cold air flow path 435 formed between the damper door 412 and the second damper cover 422 and pass through the damper passage hole 413.

Additionally, cold air that is blown from the grille fan assembly 300 may pass through the damper passage hole 413, through a sixth cold air flow path 436 formed between the damper door 412 and the damper cover step part 423 as well as the fifth cold air flow path 435.

Since a partial area of the first damper cover 421, which corresponds to the damper cover step part 423, is removed, the flow of cold air flowing into the sixth cold air flow path 436 is naturally formed, and the amount of cold air passing through the damper passage hole 413 may increase.

Figure 11:
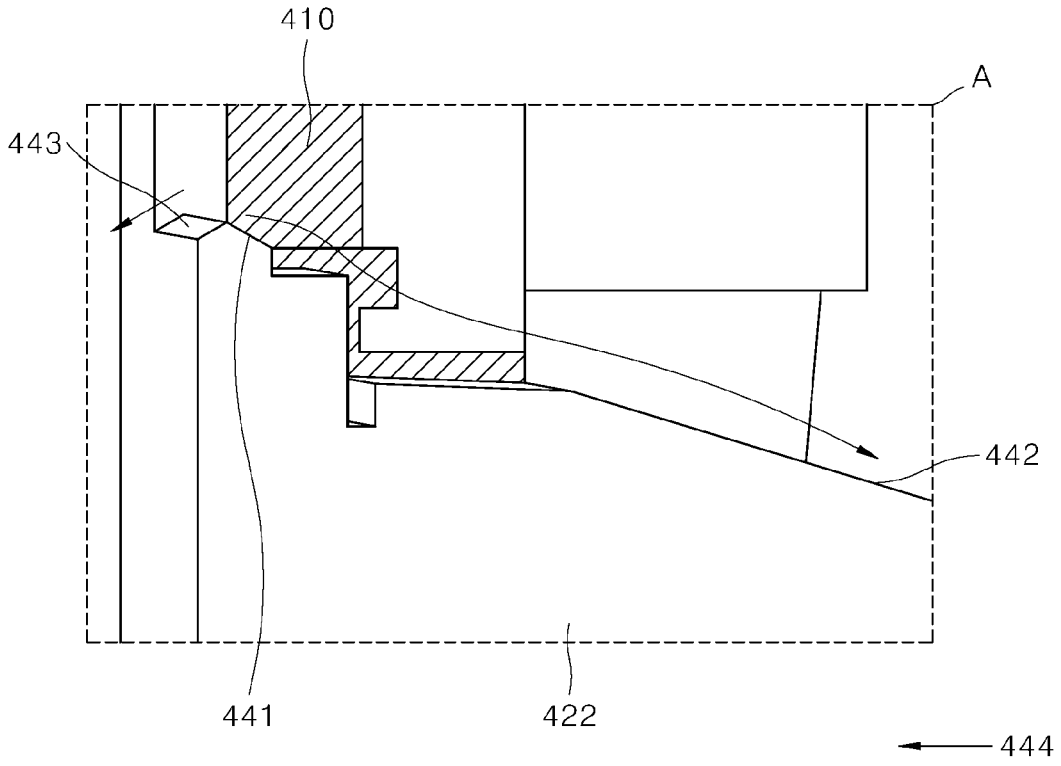
FIG. 11 is a cross-sectional view showing defrost water flowing downward, with the damper door of the flow path opening and closing module open.

FIG. 11 is a cross-sectional view showing defrost water 444 flowing downward, with the damper door 412 of the flow path opening and closing module 400 open.

Figure 16:
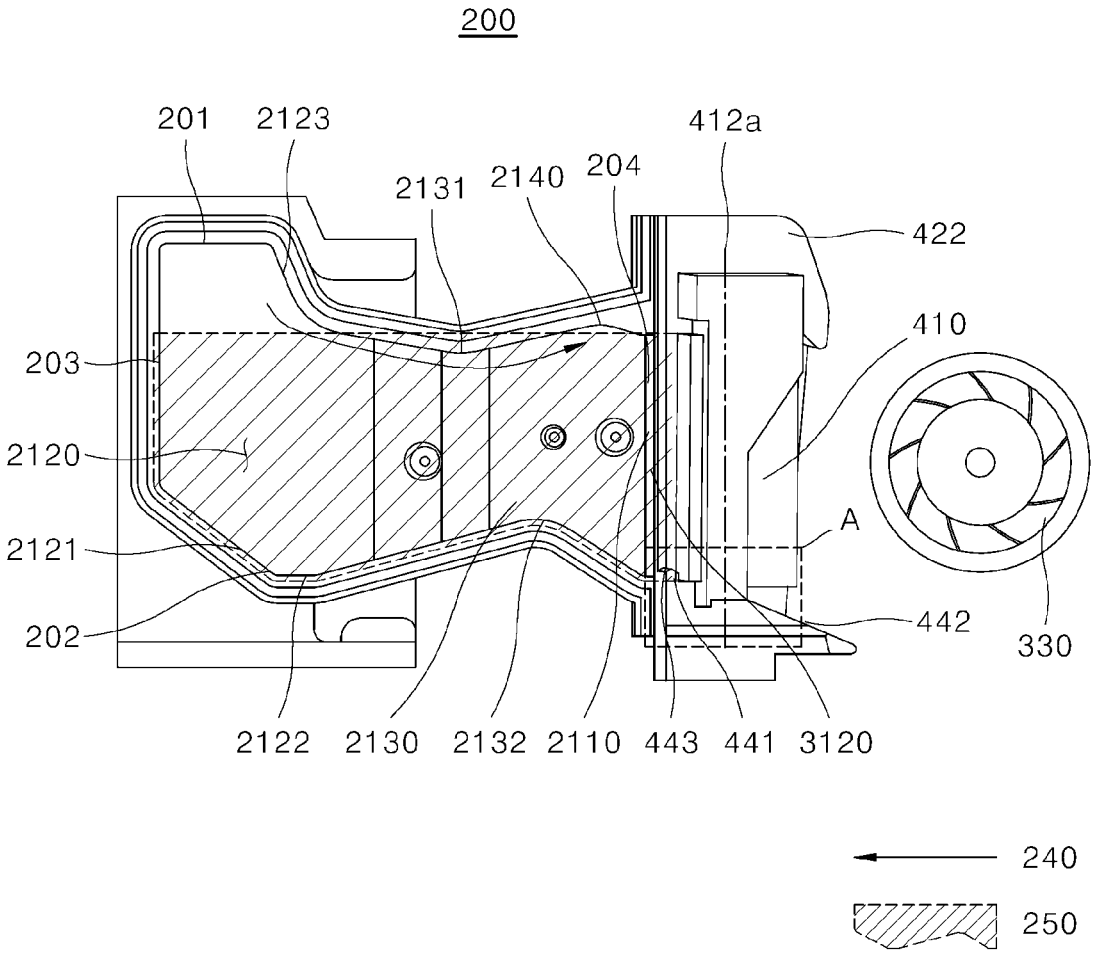
FIG. 16 is a cross-sectional view showing that a supply duct assembly and a flow path opening and closing module are coupled.

FIG. 11 is an enlarged cross-sectional view showing partial area A in FIG. 16. Description is provided with further reference to FIG. 16.

The lower area of the second damper cover 422 contacting the lower side of the damper 410 may comprise a first inclination surface 441 that inclines in the direction of the grille fan assembly 300.

Additionally, the lower area of the second damper cover 422, which does not contact the lower side of the damper 410 in the direction of the inside of the grille fan assembly 300, may comprise a second inclination surface 442 that inclines in the direction of the grille fan assembly 300.

If ice formation occurs in the supply duct assembly 200, defrosting is performed, and defrost water 444 may be generated.

At this time, if the defrost water 444 remains in the supply duct assembly 200, ice formation may occur again in the supply duct assembly 200. To discharge the defrost water 444 in the direction of the grille fan assembly 300 rather than the direction of the supply duct assembly 200 as much as possible, the first inclination surface 441 may be formed.

The end portion of one side of the damper 410 needs to be aligned with the start point of the first inclination surface 441 or disposed inside the start point, such that the defrost water 444 formed in the damper 410 may flow downward along the first inclination surface 441 in the direction of the grille fan assembly 300.

Since the damper door 412 is open in the direction of the grille fan assembly 300 as described above, most of the defrost water 444, which is generated if the defrosting process is performed near the damper door 412, may be discharged along the first inclination surface 441, in the direction of the grille fan assembly 300.

The defrost water 444 flowing along the first inclination surface 441 may be guided to be discharged along a second inclination surface 442 that is disposed at the other side of the damper 410, in the direction of the grille fan assembly 300.

The start point of the second inclination surface 442 may be a point at which a point of contact between the other side of the damper 410 and the second damper cover 422 ends, but not limited. The start point of the second inclination surface 442 may be a point where the second inclination surface 442 overlaps the lower area of the damper 410.

In particular, referring to FIGS. 11 and 16, in the cross-sectional view of the damper 410, the lower area of the damper 410 may be stepped in the direction of the grille fan assembly 300.

The lower area of the second damper cover 422, contacting the lower portion of the damper 410, comprises the second inclination surface 442 that inclines in the direction of the grille fan assembly 300. Accordingly, the defrost water 444 may collect in the step formed in the lower area of the damper 410 and discharged along the second inclination surface 442.

The second inclination surface 442 may have a longer side than the first inclination surface 441.

Additionally, a third inclination surface 443 that inclines in the direction of the supply duct assembly 200 may be formed at the opposite side of the first inclination surface 441 contacting the damper 410.

Since the third inclination surface 443 may be formed to incline in the direction of the supply duct assembly 200, the defrost water 444 that is not discharged through the first inclination surface 441 may not collect in the damper 410 but be discharged in the direction of the supply duct assembly 200. The third inclination surface 443 may help to discharge the defrost water 444.

[Supply Duct Assembly]

Hereafter, a supply duct assembly 200 of one embodiment is described with reference to FIGS. 13 to 16.

The supply duct assembly 200 may form a cold air flow path in which cold air flows, as a first supply duct part 210 and a second supply duct part 220 are coupled.

The supply duct assembly 200 may have a supply duct cold air outlet 2120, at one side thereof, and the supply duct cold air outlet 2120 may communicate with the flow path duct cold air inlet 1110 of the flow path duct assembly 100.

The supply duct cold air outlet 2120 may have a shape corresponding to the shape of the flow path duct cold air inlet 1110.

The supply duct assembly 200 may have a supply duct cold air inlet 2110, at the other side thereof, and cold air being blown from the grille fan assembly 300 may flow into the supply duct cold air inlet 2110.

The supply duct cold air inlet 2110 may have a size corresponding to the size of the damper door 412 that is exposed outward from the flow path opening and closing module 400.

Since the shape of the supply duct cold air inlet 2110 corresponds to the shape of the damper door 412 that is exposed outward, the surface area where the damper door 412 is exposed to humid air may decrease at a maximum level.

A first heat generation part 231 and a third heat generation part 233 may be respectively attached to one side and the other side of the supply duct assembly 200 additionally, and a second heat generation part 232 may be attached to the outside of the supply duct assembly 200 additionally.

The first heat generation part 231, the second heat generation part 232, and the third heat generation part 233 may be a heater that generates heat at a time of defrosting.

Since the first heat generation part 231, the second heat generation part 232 and the third heat generation part 233 may be disposed near the inlet, the flow path and the outlet of cold air, and generate heat and defrost a froze section when defrosting is required.

Referring to FIG. 16, a first lower side inclination part 2121 may be provided at the lower side 202 of the supply duct cold air outlet, and reduce an open area further toward one side 203 of the supply duct assembly 200 from the other side 204 of the supply duct assembly 200.

The first lower side inclination part 2121 may have a shape corresponding to the shape of the first inclination wall 1112*a* of the flow path duct cold air inlet 1110 described above.

Since the first lower side inclination part 2121 may serve as a structure part for preventing the drooping of cold air, the first lower side inclination part 2121 may reduce the drooping of cold air further at the supply duct cold air outlet 2120 and the flow path duct cold air inlet 1110.

A second lower side inclination part 2122 may be provided at the lower side 202 of the supply duct cold air outlet 2120, and increase the open area further toward one side 203 of the supply duct assembly 200 from the other side 204 of the supply duct assembly 200.

The second lower side inclination part 2122 may be disposed closer to the other side 204 of the supply duct assembly 200 than the first lower side inclination part 2121.

The second lower side inclination part 2122 may form a drainage gradient structure that allows defrost water formed at the supply duct assembly 200 to be drained to the flow path duct assembly 100.

A jaw part 2123 may be provided at the upper side 201 of the supply duct cold air outlet 2120, and reduce the open area further toward the other side 204 of the supply duct assembly 200 from one side 203 of the supply duct assembly 200.

If the flow path opening and closing damper 410 is closed, cold air is not discharged through the supply duct cold air outlet 2120. Accordingly, humid air 240 of the refrigerator compartment 41 may reversely flow to the supply duct assembly 200.

At this time, since the humid air 240 of the refrigerator compartment 41 flows from the first cold air outlet 1141 disposed in the upper area of the flow path duct assembly 100, the humid air 240 flowing into the supply duct cold air outlet 2120 may be drawn along the upper side 201 of the supply duct cold air outlet 2120.

To block a path into which humid air 240 flows at a maximum level, a jaw part 2123 may be formed at the upper side 201 of the supply duct cold air outlet 2120 to form a prevention jaw structure that prevents humid air 240 from flowing into the supply duct assembly 200.

A supply duct connection part 2130 may be disposed between the supply duct cold air outlet 2120 and the supply duct cold air inlet 2110, and an upper side drawn part 2131 may be provided at the upper side of the supply duct connection part 2130 and drawn inward.

The inflow of cold air flowing into the supply duct cold air outlet 2120 may be primarily prevented by the jaw part 2123 that functions as a prevention jaw structure, and secondarily prevented by the upper side drawn part 2131 that functions as a prevention jaw structure.

A lower side drawn part 2132 may be provided at the lower side 202 of the supply duct connection part 2130, and drawn inward.

The lower side drawn part 2132 may connect to the second lower side inclination part 2122, to form an inclination structure allowing defrost water to be discharged outward, at the supply duct connection part 2130.

The upper side drawn part 2131 and the lower side drawn part 2132 may be disposed not to overlap each other in the up-down direction.

If the upper side drawn part 2131 and the lower side drawn part 2132 are disposed to overlap each other in the up-don direction, the width of the cold air flow path passing through the supply duct connection part 2130 may be greatly narrowed in a certain section.

To prevent this from happening, the upper side drawn part 2131 and the lower side drawn part 2132 do not overlap each other in the up-down direction, to suppress the interference with the flow of cold air.

The supply duct cold air inlet 2110 formed at the other side 204 of the supply duct assembly 200 may communicate with the grille fan cold air outlet 3120, and specifically, the flow path opening and closing damper 410 may be disposed at the supply duct cold air inlet 2110.

The damper 410 may be elongated and disposed in the perpendicular direction.

For example, the rotation shaft 412*a* of the damper door may be disposed in parallel with the supply duct cold air inlet 2110 of the supply duct assembly 200.

Since the damper 410 is disposed in the perpendicular direction, the natural flow of cold air being discharged to the supply duct cold air inlet 2110 may be induced.

If the damper 410 is disposed at a slant, defrost water may not be discharged outward in the state of collecting in an inclined step. However, since the damper 410 is elongated and stands in the perpendicular direction, instead of being disposed at a slant, the collection of defrost water in the step may be suppressed.

The uppermost end of the damper passage hole 413 may be disposed lower than the uppermost end of the flow path duct cold air inlet 1110.

Referring to FIG. 16, even when the damper 410 is closed, cold air that has already been drawn may form a cold air trap 250 space in which cold air fills the space of the supply duct assembly 200 from the lowermost end of the damper passage hole 413 of the damper 410 to the uppermost end of the damper passage hole 413 of the damper 410.

If the cold air trap 250 space is formed in the supply duct assembly 200, humid air 240 reversely flowing to the supply duct assembly 200 may be trapped in the cold air trap 250, and the inflow of the humid air may decrease.

The uppermost end of the damper passage hole 413 is disposed lower than the uppermost end of the flow path duct cold air inlet 1110, to trap the humid air 240 in the cold air trap 250.

Additionally, the uppermost end of the damper passage hole 413 is disposed higher than the upper side drawn part 2131, such that the humid air 240 having passed the jaw part 2123 that is a primary prevention jaw structure and having flown to the upper side drawn part 2131 that is a secondary prevention jaw structure may be trapped in the cold air trap 250 without passing through the upper side drawn part 2131.

Further, an upper side protrusion part 2140 may be formed at the upper side of the supply duct connection part 2130 between the upper side drawn part 2131 and the damper 410, and protrude upward.

The upper side protrusion part 2140 may be disposed higher than the uppermost end of the damper passage hole 413.

The humid air 240 having passed through the upper side drawn part 2131 that is a secondary prevention jaw structure and then the cold air trap 250 may flow to a vacant protrusion space of the upper side protrusion part 2140, and may not directly contact the damper door 412 that is exposed by the damper passage hole 413.

As described above, the refrigerator 1 according to the present disclosure may ensure the suppression of ice formation of the cold air flow path of the supply duct assembly 200 and the flow path opening and closing damper 410, through the flow path duct assembly 100 having a novel structure, the supply duct assembly 200 having a novel structure, and the flow path opening and closing module 400 having a novel structure and a novel arrangement.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the scope of the disclosure though not explicitly described in the description of the embodiments.

The invention claimed is:

1. A refrigerator, comprising:

a freezer compartment;

a refrigerator compartment disposed at a side of the freezer compartment;

a flow path duct assembly that is disposed at a rear of the refrigerator compartment and defines a cold air flow path;

a grille fan assembly disposed at a rear of the freezer compartment; and a supply duct assembly configured to supply cold air from the grille fan assembly to the flow path duct assembly, the supply duct assembly having (i) a first side in fluid communication with the flow path duct assembly and (ii) a second side in fluid communication with the grille fan assembly, wherein the flow path duct assembly comprises a flow path duct cold air inlet that is depressed to fluidly communicate with the supply duct assembly, wherein a portion of the cold air flow path is exposed to and open at an upper portion of the flow path duct cold air inlet to thereby provide the cold air flows in an upward direction relative to the flow path duct cold air inlet, and wherein the flow path duct assembly further comprises a plurality of walls that define the flow path duct cold air inlet, the plurality of walls including a lower side wall that is configured to prevent the cold air from flowing in a downward direction relative to the flow path duct cold air inlet.

2. The refrigerator of claim 1, wherein the plurality of walls surround the flow path duct cold air inlet, the plurality of walls comprising:

the lower side wall, the lower side wall comprising a first inclination wall and a second inclination wall that protrude in a downward direction;

a first side wall that extends from the first inclination wall in an upward direction; and a second side wall that extends from the second inclination wall in the upward direction and faces the first inclination wall.

3. The refrigerator of claim 1, wherein the flow path duct assembly further comprises a step part disposed below the flow path duct cold air inlet.

4. The refrigerator of claim 2, wherein the flow path duct assembly further comprises a first cold air guide part that defines a first region at an upper area of the flow path duct assembly, and wherein the first cold air guide part has a first wall and a second wall, the second wall corresponding to the first side wall of the flow path duct cold air inlet.

5. The refrigerator of claim 4, wherein the flow path duct assembly further comprises a first cold air outlet configured to supply cold air to the refrigerator compartment, and wherein the first cold air outlet is disposed at upper portions of the first cold air guide part and the flow path duct cold air inlet, the first cold air outlet being spaced apart from the first cold air guide part and the flow path duct cold air inlet.

6. The refrigerator of claim 5, wherein the flow path duct assembly further comprises a second cold air guide part that defines a second region at a lower portion of the first cold air guide part, the second cold air guide part being spaced apart from the first cold air guide part.

7. The refrigerator of claim 6, wherein the cold air flow path comprises:

a first cold air flow path configured to guide cold air from the flow path duct cold air inlet to the first cold air outlet along the second wall of the first cold air guide part;

a second cold air flow path branched from the first cold air flow path and configured to guide cold air along an upper side wall of the first cold air guide part, the first wall of the first cold air guide part, and a first wall of the second cold air guide part;

a first subsidiary cold air outlet defined at a side of the first cold air outlet;

a third cold air flow path branched from the second cold air flow path and configured to guide cold air to the first subsidiary cold air outlet; and a fourth cold air flow path branched from the second cold air flow path and configured to guide cold air along a second wall of the second cold air guide part.

8. The refrigerator of claim 7, wherein the second cold air guide part is configured to:

guide a first amount of cold air along the first wall of the second cold air guide part; and guide a second amount of cold air along the second wall of the second cold air guide part, the first amount of cold air being greater than the second amount of cold air.

9. The refrigerator of claim 5, wherein the first cold air outlet, the first cold air guide part, and the flow path duct cold air inlet are arranged along an up-down direction.

10. The refrigerator of claim 5, wherein the first cold air guide part comprises a subsidiary cold air guide part disposed at an upper side of the first cold air guide part, the subsidiary cold air guide part comprising a third inclination wall and a fourth inclination wall that protrude in the upward direction, wherein the fourth inclination wall is disposed closer to the flow path duct cold air inlet than the third inclination wall, and wherein a length of the third inclination wall is greater than a length of the fourth inclination wall.

11. The refrigerator of claim 7, wherein the second cold air guide part comprises a lower side extension part that extends from a lower side of the second cold air guide part in the downward direction, wherein a width of the lower side extension part decreases as the lower side extension part extends in the downward direction, wherein the lower side extension part defines a curved surface that is curved about a curvature center at one side of the lower side extension part, and wherein the second cold air flow path extends along the curved surface of the lower side extension part.

12. The refrigerator of claim 1, wherein the supply duct assembly comprises:

a supply duct cold air outlet that is defined at the first side of the supply duct assembly and in fluid communication with the flow path duct cold air inlet;

a supply duct cold air inlet that is defined at the second side of the supply duct assembly and is in fluid communication with the grille fan assembly; and a first lower side inclination part disposed at a lower side of the supply duct cold air outlet, and wherein an open area of the supply duct assembly decreases along the first lower side inclination part from the second side of the supply duct assembly toward the first side of the supply duct assembly.

13. The refrigerator of claim 12, wherein the supply duct assembly further comprises a second lower side inclination part disposed at the lower side of the supply duct cold air outlet, wherein the second lower side inclination part is disposed closer to the second side of the supply duct assembly than the first lower side inclination part, and wherein the open area of the supply duct assembly increases along the second lower side inclination part from the second side of the supply duct assembly toward the first lower side inclination part.

14. The refrigerator of claim 12, wherein the supply duct assembly further comprises a jaw part that is disposed at an upper side of the supply duct cold air outlet, and wherein the open area of the supply duct assembly decreases along the jaw part from the first side of the supply duct assembly toward the second side of the supply duct assembly.

15. The refrigerator of claim 12, wherein the supply duct assembly further comprises:

a supply duct connection part disposed between the supply duct cold air outlet and the supply duct cold air inlet; and an upper side drawn part recessed from an upper side of the supply duct connection part toward the open area of the supply duct assembly.

16. The refrigerator of claim 15, wherein the supply duct assembly further comprises a lower side drawn part recessed from a lower side of the supply duct connection part toward the open area of the supply duct assembly, and wherein the upper side drawn part and the lower side drawn part is offset from each other in a direction toward the first or second side of the supply duct assembly.

17. The refrigerator of claim 1, wherein the grille fan assembly comprises a damper configured to selectively block cold air from being supplied to the supply duct assembly, the damper comprising:

a damper case that defines a damper passage hole configured to provide cold air to the supply duct assembly;

a damper door disposed at a first surface of the damper case and configured to open and close the damper passage hole, the first surface of the damper case facing an inside of the grille fan assembly; and a damper operation motor disposed at the damper case and configured to operate the damper door to open and close the damper passage hole, and wherein the damper door is configured to open or close the damper passage hole in a direction toward the inside of the grille fan assembly.

18. The refrigerator of claim 17, wherein an uppermost end of the damper passage hole is disposed lower than an uppermost end of the flow path duct cold air inlet.

19. The refrigerator of claim 17, wherein the damper door is configured to rotate about a rotation shaft to thereby open and close the damper passage hole, and wherein the supply duct assembly defines a supply duct cold air inlet that faces the damper passage hole and extends in a direction parallel to the rotation shaft.

20. The refrigerator of claim 17, wherein the grille fan assembly further comprises a first damper cover and a second damper cover that surround the damper, wherein the damper door is configured to be opened in a direction toward the first damper cover, and wherein the first damper cover comprises a damper cover step part configured to overlap with at least a portion of the damper door based on the damper door being opened.

21. The refrigerator of claim 20, wherein the grille fan assembly defines:

a second cold air flow path configured to communicate cold air between the damper door and the second damper cover; and a third cold air flow path configured to communicate cold air between the damper door and the damper cover step part, and wherein the damper passage hole is configured to transmit the cold air blown through the second cold air flow path and the third cold air flow path to the supply duct assembly.

22. The refrigerator of claim 20, wherein the second damper cover has a first inclination surface that is disposed at a lower area of the second damper cover and in contact with a lower side of the damper, the first inclination surface being inclined toward the grille fan assembly.

* * * * *